US009267346B2

(12) United States Patent
Robertson et al.

(10) Patent No.: US 9,267,346 B2
(45) Date of Patent: Feb. 23, 2016

(54) SYSTEMS AND METHODS FOR MONITORING A WELLBORE AND ACTUATING A DOWNHOLE DEVICE

(75) Inventors: Michael C. Robertson, Arlington, TX (US); William F. Boelte, New Iberia, TX (US); Douglas J. Streibich, Fort Worth, TX (US); Daniel Glenn Jumper, Fort Worth, TX (US)

(73) Assignee: Robertson Intellectual Properties, LLC, Burleson, TX (US)

( * ) Notice: Subject to any disclaimer, the term of this patent is extended or adjusted under 35 U.S.C. 154(b) by 797 days.

(21) Appl. No.: 13/507,463

(22) Filed: Jul. 2, 2012

(65) Prior Publication Data

US 2014/0000877 A1 Jan. 2, 2014

(51) Int. Cl.

| | |
|---|---|
| ***E21B 43/11*** | (2006.01) |
| ***E21B 43/1185*** | (2006.01) |
| ***E21B 47/06*** | (2012.01) |
| ***E21B 23/00*** | (2006.01) |
| ***E21B 41/00*** | (2006.01) |
| ***E21B 47/01*** | (2012.01) |

(52) U.S. Cl.

CPC ..... *E21B 23/00* (2013.01); *E21B 41/00* (2013.01); *E21B 43/11* (2013.01); *E21B 43/1185* (2013.01); *E21B 47/01* (2013.01); *E21B 47/06* (2013.01)

(58) Field of Classification Search

CPC ..... E21B 47/01; E21B 47/011; E21B 23/00; E21B 41/00; E21B 43/11; E21B 43/1185; E21B 47/06

USPC ..... 166/381

See application file for complete search history.

(56) References Cited

U.S. PATENT DOCUMENTS

| | | | | |
|---|---|---|---|---|
| 4,100,978 | A * | 7/1978 | Boop | F24D 1/05 102/306 |
| 8,220,545 | B2 * | 7/2012 | Storm, Jr. | E21B 47/011 166/302 |
| 8,750,075 | B2 * | 6/2014 | Rayssiguier | E21B 47/011 367/81 |
| 2001/0012703 | A1 * | 8/2001 | Wurm | E21B 3/02 439/32 |
| 2007/0007016 | A1 * | 1/2007 | Sanderlin | E21B 47/00 166/381 |
| 2010/0212396 | A1 * | 8/2010 | Zenisek | E21B 47/01 73/1.57 |
| 2011/0079391 | A1 * | 4/2011 | Bedouet | E21B 47/011 166/302 |
| 2012/0096935 | A1 * | 4/2012 | Finke | E21B 47/01 73/152.03 |

* cited by examiner

*Primary Examiner* — Kenneth L Thompson
*Assistant Examiner* — Wei Wang

(57) ABSTRACT

Systems and methods for monitoring a wellbore and actuating a downhole device include a body adapted for insertion into the wellbore that contains a processor, data storage, and sensors that detect a pressure, temperature, and acceleration associated with the body. Computer instructions are usable to receive and store preselected parameters, which include pressure, temperature, and acceleration ranges, and to compare measured values to these ranges for forming a determination usable to initiate actuation of a downhole tool. Additional parameters, such as temporal parameters, can be used to allow, cease, reset, or prevent actuation of the downhole tool.

40 Claims, 15 Drawing Sheets

SYSTEMS AND METHODS FOR MONITORING A WELLBORE AND ACTUATING A DOWNHOLE DEVICE

FIELD

Embodiments usable within the scope of the present disclosure relate, generally, to systems and methods for monitoring (e.g., logging) a wellbore and actuating a downhole device, and more specifically to remote actuation devices and methods usable to actuate packers, cutters, torches, perforators, setting tools, and/or other types of explosive and non-explosive downhole tools responsive to detected conditions in a wellbore.

BACKGROUND

Conventionally, when it is desired to actuate a downhole tool, such as a packer, a cutter, a torch, a perforating gun, a setting tool, or a similar type of apparatus, a two-part process must be performed. First, a logging tool must be lowered into a wellbore, to the desired location, and used to record the wellbore temperature and pressure at that location. After the logging tool is retrieved to the surface, this data is used to program the downhole tool and/or an associated actuation tool with predetermined values. Specifically, the downhole tool and/or the actuation tool is programmed with an expected or predetermined pressure or pressure range, and an expected or predetermined temperature or temperature range, and then the downhole tool and/or the actuation tool is/are lowered into the wellbore. When these programmed conditions are detected by the downhole tool and/or the actuation tool, it is assumed that the downhole tool is located at the desired location, and the tool is actuated.

Typically, the tool is lowered into the wellbore with an associated timer to prevent premature actuation of the tool, such as an unexpected increase in temperature or pressure caused by the exodus of gas from the well, which could increase the pressure and temperature to the programmed levels prior to the tool reaching the desired depth. The timer is programmed at the surface of the well with a preset duration, estimated to be the approximate amount of time required for the tool the reach the desired location in the well. After the preset duration expires, the tool becomes "armed," such that exposure to the programmed temperature and pressure will cause the tool to become actuated. If the tool does not reach the desired location within the preset time interval for any reason, the tool may become actuated at a different location, if the programmed pressure and temperature values are detected elsewhere in the wellbore. Further, if the tool does not become actuated at the desired location for any reason, it must be retrieved to the surface in an armed state, which can potentially cause unintended actuation at an undesired location during retrieval and related damage to the wellbore, or the possibility of an actuation at the surface, which can cause catastrophic damage and/or injury.

Because logging and tool actuation are performed as separate operations, the reasons that a downhole tool fails to actuate at the proper location may be difficult to determine. The ambient temperature and pressure of the wellbore is typically not logged when lowering a downhole tool, primarily due to the size of the components involved. A downhole tool, when engaged with an actuation tool, may have a length of thirty feet or greater. The addition of a logging tool to this lengthy assembly can cause the overall length to become prohibitive.

Additionally, conventional actuation tools are subject to other inherent difficulties, such as poor battery life and/or the use of potentially hazardous batteries (e.g., lithium batteries, which can be subject to restrictions on transport, use, and disposal thereof), and improper grounding. The high temperature environment within a wellbore significantly reduces the life of batteries, such that it becomes necessary to lower and actuate a tool quickly, before the loss of battery power prevents further operation of the tool. To at least slightly extend the battery life of such tools, conventional actuation tools are normally powered using dangerous lithium and/or cadmium batteries, which are subject to burdensome regulations regarding the transport, use, and disposal thereof, primarily due to the possibility of explosion as well as the possibility of negative environmental impact following disposal. Further, one of the primary reasons for the failure to actuate downhole tools is improper grounding thereof, as the proper grounding is often difficult to verify until the tool has successfully been actuated. However, until a tool has been retrieved to the surface, normally in an "armed" state, as described above, the reason a tool has failed to actuate, whether due to improper grounding or another cause, is normally unknown.

A need exists for a logging and actuation tool that overcomes one or more of the above-referenced deficiencies by reducing or eliminating the possibility of actuation at an improper location, providing a more reliable mechanism for grounding the tool, and significantly reducing the size of the overall tool to enable simultaneous logging and actuation runs, while also increasing the possible uses for such a tool, such as by sizing the tool to enable insertion into coiled tubing or similar narrow conduits, such as small diameter pipe (e.g., having a diameter of 2 inches or less) and/or conduits having narrow restrictions.

A need also exists for a combined logging and actuation tool that is safe to operate, easy and inexpensive to transport, and can be powered using non-hazardous power sources, thus reducing the expense associated with transport and/or disposal of materials.

SUMMARY

Embodiments usable within the scope of the present disclosure relate to systems and methods usable for monitoring (e.g., logging) conditions in a wellbore (e.g., temperature, pressure, acceleration of the monitoring tool), and for actuating an associated downhole device (e.g., a packer, torch, cutter, perforator, setting tool, or other similar explosive or non-explosive tool). The tool generally includes an elongate body, which in an embodiment, can be sized for insertion into a narrow conduit, such as coiled tubing or small diameter pipe (e.g., having a diameter of 2 inches or less). For example, the body of the tool could have a diameter of approximately 0.875 inches. In other embodiments, the body can include outer housing members, adapted to absorb loads applied to the body and distribute the loads along the housing. Housing members can be provided with other desired diameters (e.g., 1.5 inches or 2.5 inches), and can be positioned over the elongate body of the tool and interchanged as needed to enable insertion of the tool into desired conduits and/or wellbores. In further embodiments, the housing members can be insulated (e.g., using Pyroflask® technology or similar insulated members), to shield the internal components of the tool from ambient wellbore temperatures, thus prolonging the life of any batteries or other power sources used. While the form and/or configurations of the elongate body and/or the housing can vary, embodiments can include first and second members, connected via a connector, with one or more end members adapted for engaging conduits for lowering the tool (e.g., wireline and/or slickline) and/or other components (e.g., a downhole tool, a pressure transducer or similar sensor, etc.). In an embodiment, the elongate body can have a length ranging from 30 inches to 50 inches, which is significantly less than the length of conventional actuation tools.

A processor can be positioned within the elongate body (e.g., integral with and/or otherwise associated with a circuit board and related components), in communication with data storage (e.g., EEPROM or other types of memory), and with a plurality of sensors. Specifically, a first sensor, such as a pressure transducer, adapted to detect a pressure associated with and/or otherwise applied to the body, can be used to measure ambient wellbore pressure; a second sensor, such as a thermistor, adapted to detect a temperature associated with and/or otherwise applied to the body, can be used to measure ambient wellbore temperature; and a third sensor, such as an accelerometer and/or gyroscope, can be used to detect the acceleration of the elongate body. During typical use, the accelerometer can be used to detect acceleration along two axes (e.g., X and Y), to determine movement of the tool within the wellbore in perpendicular directions; however, in an embodiment, acceleration can be detected along three axes (e.g., X, Y, and Z), such that the recorded acceleration of the tool can be converted (e.g., integrated) to determine the position of the tool.

Computer instructions within the data storage instruct the processor to receive and store pressure, temperature, and acceleration values obtained from the sensors. During use, the tool can first be lowered into a wellbore to monitor and/or log the wellbore conditions, thus recording expected pressure, temperature, and acceleration values at a desired location. This data can be extracted from the data storage, either by a direct connection to the processor (e.g., after retrieval of the tool to the surface), or in an embodiment, a wireless connection (e.g., Bluetooth or similar technology). Use of a wireless connection enables data to be extracted from the tool without requiring disassembly of any portion thereof, which avoids undesirable wear on threads, O-rings, and/or similar connecting or sealing elements, and in an embodiment, can enable extraction of data without requiring retrieval of the tool.

Further, after retrieval to the surface, the tool can then be programmed, or in an embodiment, the tool can be remotely programmed from the surface while within the wellbore. Specifically, computer instructions within the data storage instruct the processor to receive and store preset parameters, e.g., a first preselected parameter that includes a pressure range, a second preselected parameter that includes a temperature range, and a third preselected parameter that includes an acceleration range. After lowering the programmed tool into the wellbore, the sensors can be used to monitor the temperature, pressure, and acceleration associated with the tool body, which can be compared with the preselected temperature, pressure, and acceleration ranges to form a determination. Responsive to the determination (e.g., if the ambient pressure, temperature, and acceleration all fall within the preselected ranges), an actuation process can be initiated.

The specific actuation process can vary, e.g., depending on user-selected preferences. For example, in an embodiment, computer instructions can cause the processor to receive and store one or multiple preselected temporal parameters (e.g., time durations), a first of which can begin elapsing after detection of a pressure, temperature, and acceleration that fall within the programmed ranges. A second temporal parameter (e.g., a time duration) can begin elapsing after the first temporal parameter has lapsed, and once the second temporal parameter has lapsed, the downhole tool can be actuated. As such, embodiments usable within the scope of the present disclosure enable a tool to be programmed in a manner that accounts for unexpected, temporary fluctuations in wellbore temperature and/or pressure. Specifically, if a measured pressure, temperature, and acceleration are not maintained within the programmed ranges for the first preselected duration, the actuation process can be reset and/or not initiated. Embodiments usable within the scope of the present disclosure also enable a tool to be programmed with a time duration that does not begin elapsing until the programmed temperature, pressure, and acceleration conditions are met, for a programmed duration, e.g., the second preselected duration does not begin elapsing until after the pressure/temperature/acceleration conditions have been met for the first duration. Conversely, conventional tools incorporate a timer that is initiated at the surface, after which the tool becomes immediately armed (e.g., prepared to actuate once the desired conditions are met), rather than a timer that does not begin elapsing until after the programmed conditions are met.

In a further embodiment, the tool can continue monitoring the ambient pressure, temperature, and acceleration, and comparing these measurements with the programmed ranges. If one of the measured values falls outside of the respective programmed range during either of the temporal durations, the actuation process can be ceased. Ceasing of the actuation process can simply involve resetting the temporal parameters, such that they will begin to elapse when the measured conditions again fall within the programmed ranges. In an embodiment, the tool can be provided with a failsafe temporal parameter (e.g., a time duration), which can be initiated automatically (e.g., upon measurement of certain conditions), manually (e.g., by a user at the surface), or simply upon initiating an operation, such that if the failsafe temporal parameter lapses, the tool will become inoperative (e.g., such that the actuation process cannot be initiated). For example, the tool can be programmed such that before the actuation process can again be initiated, the tool must be retrieved to the surface, reset, and the logged data must be extracted from the data storage.

Due to the reduced size of embodiments of the present actuation tool, in an embodiment, the tool can include one or more power sources within the body thereof. Specifically, certain embodiments can be operated using non-hazardous, readily available power sources, such as AAA batteries. In other embodiments, the tool can include an in situ power generator, such as a fluid-driven and/or mechanical power source. For example, one embodiment can include a windable spring coupled with a release mechanism, that is inserted into the well with the spring wound. The release mechanism can be actuated (e.g., when the temporal durations lapse and/or when the programmed conditions are detected), allowing unwinding of the spring and thus, powering of one or more elements of the tool.

To facilitate grounding of the tool, embodiments can include a housing having connectors adapted to connect multiple parts of the housing together and/or end pieces adapted to connect the tool to adjacent components (e.g., wireline and/or slickline, sensors, downhole tools, etc.). The connectors and/or end pieces can include one or more grounding springs (e.g., a garter spring) positioned about the circumference thereof, thus placing this grounding element between the connector and the adjacent housing portion of the tool. As such, the tool is grounded across the body, itself, resulting in a more reliable ground than conventional methods.

Embodiments usable within the scope of the present disclosure also relate to a kit for monitoring a wellbore and actuating a downhole device that includes a remote actuation mechanism, as described above, with one or more housing elements. For example, the actuation mechanism can be provided with inner wetted housing members having a diameter of 0.875 inches, usable with or independent from interchangeable, attachable outer housing members having diameters of 1.5 inches and 2.5 inches, for use within conduits and/or wellbores having differing diameters. Embodiments of such a kit can further include one or more power sources, including fuel cells (e.g., AAA batteries) and/or in situ power generators. Further embodiments can include a display and input device adapted to directly and/or wirelessly interface with the processor and/or data storage of the tool to input parameters and extract measured data. Embodiments can also include testing and/or calibration tools, such as a calibrated device adapted for threading into an end of the tool to test a pressure transducer or similar sensor therein.

Embodiments usable within the scope of the present disclosure thereby provide systems and methods that reduce or eliminate the possibility of actuation at an improper location, while enabling logging during an actuation operation, and use within coiled tubing and/or small diameter pipe.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
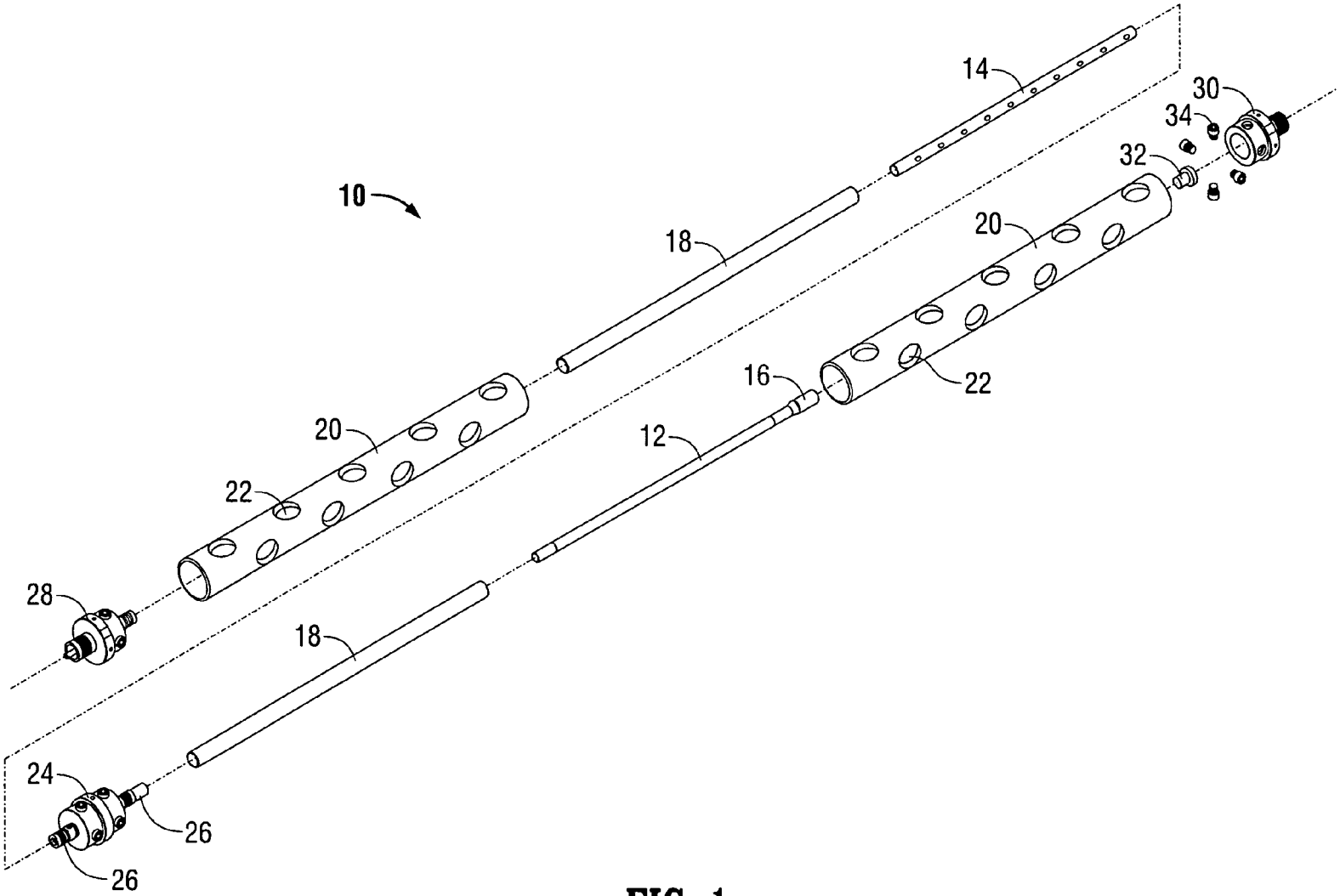
FIG. 1 depicts an exploded view of an embodiment of an actuation tool usable within the scope of the present disclosure.

Referring now to FIG. 1, an exploded view of an embodiment of an actuation tool (10) usable within the scope of the present disclosure is shown. The actuation tool (10) is shown having an elongate body with a first member (12) attachable to a second member (14). The members (12, 14) of the body are shown as generally tubular (e.g., cylindrical) components, having a diameter of approximately 0.875 inches; however, it should be understood that components having any shape and/or dimensions can be used without departing from the scope of the present disclosure. While the configuration of components within the depicted tool (10) can vary, typically, the first member (12) of the body would contain a processor and circuit board, data storage, and various sensors, including a thermistor, an accelerometer, and a pressure transducer assembly (16). The second member (14) of the body can contain one or more power sources for the tool (10). Due to the comparatively small size and/or diameter of the tool (10), conventional, non-hazardous, unrestricted power sources, such as a plurality of AAA batteries, can be used to facilitate movement, operation, and/or actuation of the tool (10).

FIG. 1 depicts two inner housing members (18), each adapted for positioning over a respective member (12, 14) of the body. In an embodiment, the inner housing members (18)

can be identical and interchangeable with one another, and are shown having a diameter of approximately 0.875 inches. Generally, the first and second members (12, 14) can be provided with a diameter slightly smaller than that of the inner housing members (18) to facilitate insertion therein. When desired, the inner housing members (18) can be used independent of any other housing, for insertion into coiled tubing and/or a similar narrow conduit and/or wellbore, and/or a conduit or wellbore having a narrow restriction therein. The inner housing members (18) are shown as generally tubular (e.g., cylindrical) members, which can be formed from metal and/or any other generally rigid material able to withstand ambient wellbore conditions.

FIG. 1 further depicts two outer housing members (20), each adapted for positioning over a respective inner housing member (18), to provide added structural support and/or insulation to the components of the tool (10). In an embodiment, the outer housing members (20) can be identical and interchangeable with one another, and are shown having a diameter of approximately 2.5 inches, usable for insertion into appropriately sized wellbores and/or conduits. The depicted housing members are shown as generally tubular (e.g., cylindrical) members, which can be formed from metal and/or any other generally rigid material able to withstand ambient wellbore conditions, and are further shown having a plurality of orifices (22) formed therein, usable to lighten the outer housing members (20) and/or permit transmission of gas therethrough. In use, the weight of the tool (10) and/or any attached loads and/or devices, as well as any pressure from the wellbore, is distributed along the outer housing members (20), avoiding application of such forces to the internal components of the tool (10). In an alternate embodiment, the outer housing members (20) could be generally continuous, insulated members (e.g., Pyroflask® members), used to protect and insulate the batteries of the tool (10) and/or other components from the ambient temperature of the wellbore.

A central connector (24) is shown for engaging respective outer housing members (20) to one another, for engaging respective inner housing members (18) to one another, and for engaging the members (12, 14) of the body to one another, e.g., by threading, a force fit, and/or use of pins, screws, and/or other connectors and/or fasteners. When assembled, the connector (24) can facilitate distribution of load and/or torque along the outer housing members (20). Specifically, the ends (26) of the connector (24) can include suitable contacts for engagement and electrical communication between the members (12, 14) of the body, e.g., for transmitting power from batteries or similar items in one of the body members (14) to components in the other of the body members (12), while also serving as structural members for enabling a secure physical engagement therebetween.

FIG. 1 further shows a bottom connector (28), adapted for connection to the lower end of the bottommost housing members (18, 20) and to the lower member (14) of the elongate body of the tool (10). The bottom connector (28) is usable for connection to additional tools and/or components and/or communication between the wellbore environment and sensors within the tool (10). FIG. 1 also shows a top connector (30), adapted for connection to the upper end of the uppermost housing members (18, 20) and to the upper member (12) of the elongate body of the tool. The top connector (30) is usable for connection to conduits (e.g., wireline or slickline) usable to lower and raise the tool (10) within a wellbore, and/or for connection to additional tools and/or components. The depicted embodiment includes a transducer plug (32) associated with the top connector (30), which engages the pressure transducer assembly (16) and transmits wellbore pressure received by the top connector (30) to the pressure transducer assembly (16) for measurement thereof. A plurality of socket head screws (34) are shown, usable to connect the top connector (30) to the upper outer housing member (20) and/or other components of the tool (10). Use of socket head screws (34) within corresponding bores enables the broad heads of the screws (34) to receive at least a portion of the forces experienced between the top connector (30) and other parts of the tool (10).

Figure 2:
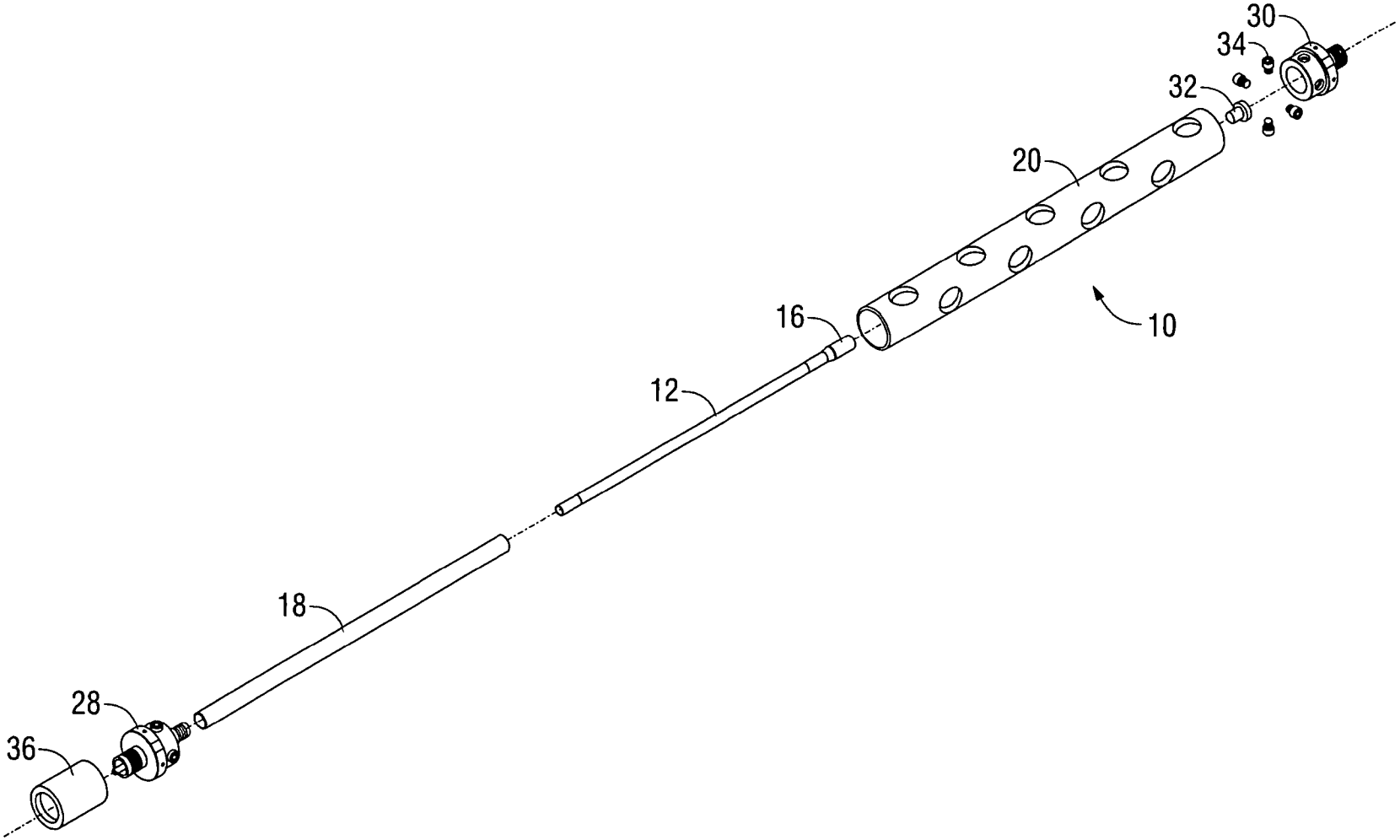
FIG. 2 depicts an exploded view of an alternate embodiment of the actuation tool of FIG. 1.

Referring now to FIG. 2, an exploded view of an alternate embodiment of the actuation tool (10) of FIG. 1 is shown, having the body member (12) containing the processor, circuit board, and/or pressure transducer assembly (16), as described previously, an inner housing member (18) sized to be positioned over the body member (12), and an outer housing member (20) sized to be positioned over the inner housing member (18). FIG. 2 also depicts the bottom connector (28), top connector (30), transducer plug (32) and socket head screws (34), as described above.

In contrast to the embodiment shown in FIG. 1, the tool (10) of FIG. 2 omits the bottommost body portion (14, shown in FIG. 1), and the bottommost inner and outer housing members (18, 20, shown in FIG. 1). The connector (24, shown in FIG. 1) is also omitted. In lieu of these components, FIG. 2 depicts an in situ power generator (36) engaged with the tool body member (12). The in situ power generator (36) can be externally engaged with the tool body member (12), or internally contained therein. Use of an in situ power generator (36) enables the overall length of the tool (10) to be significantly shortened, while also overcoming the deficiencies of batteries and/or similar power sources, such as reduced battery life when exposed to wellbore temperatures.

Figure 3:
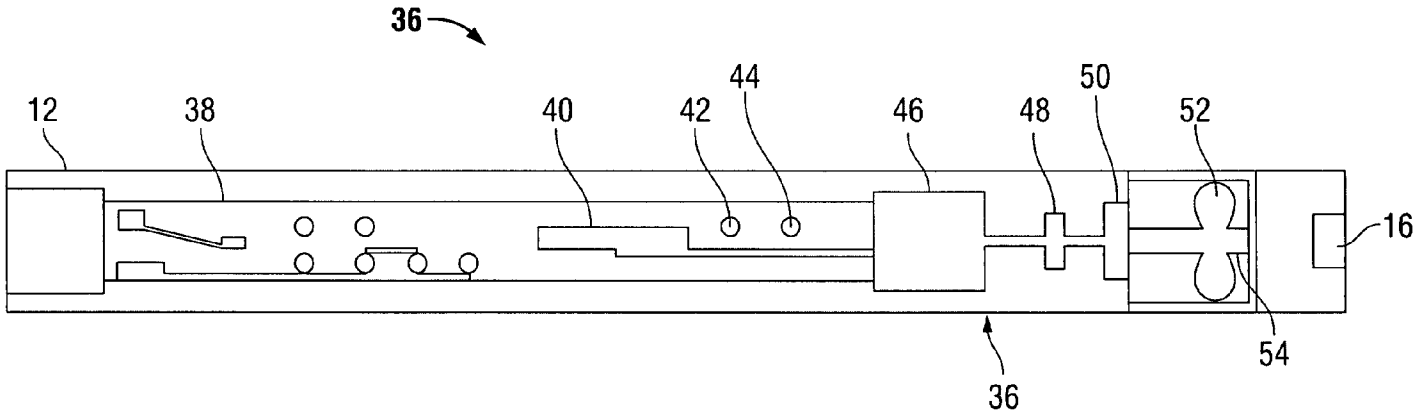
FIG. 3 depicts a diagrammatic view of an embodiment of a power generator usable with the actuation tool of FIG. 2.
Figure 4:
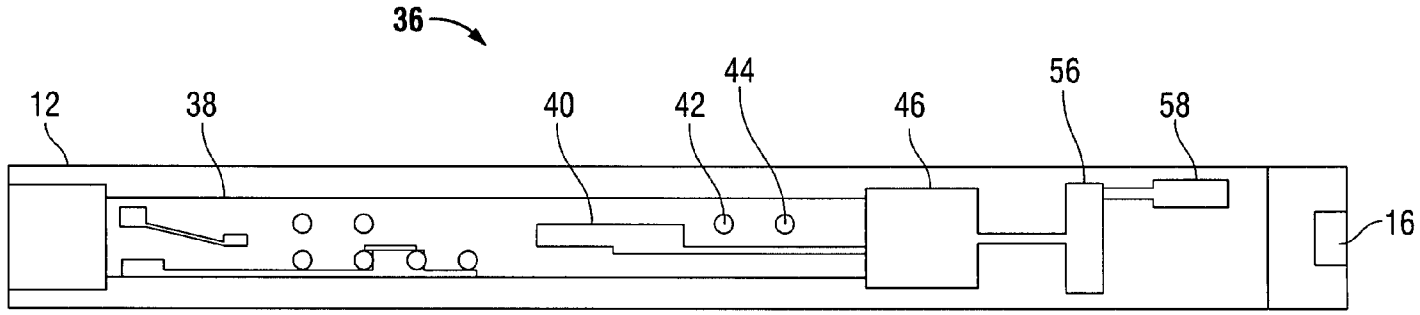
FIG. 4 depicts a diagrammatic view of an alternate embodiment of a power generator usable with the actuation tool of FIG. 2.

FIGS. 3 and 4 depict diagrammatic views of two possible embodiments of an in situ power generator (36) usable within the scope of the present disclosure. Specifically, FIG. 3 depicts a fluid-driven embodiment of the power generator (36), in which the body portion (12) of the actuation tool is shown, having the pressure transducer assembly (16) at an end thereof, as described previously. The interior portion of the tool body (12) is shown having a circuit board (38) therein, which includes a microprocessor (40), an acceleration sensor (42) (e.g., an accelerometer), and a temperature sensor (44) (e.g., a thermistor), mounted thereon. The circuit board (38) is shown associated with the in situ power generator (36), which includes a generator (46), engaged with a gearbox (48), which engages a bulkhead (50), which is associated with a caged vane (52) mounted about a shaft (54). In use, fluid circulation rotates the vane (52), which turns the shaft (54), thereby powering the generator (46) via the gearbox (48), which in turn provides power to the circuit board (38) and the components mounted thereon and/or associated therewith (e.g., the processor (40) and sensors (16, 42, 44)). Movement of the vane (52) and/or shaft (54) can be restricted until it is desirable for an actuation process to be initiated (e.g., through use of temporal parameters and/or programmed pressure, temperature, and acceleration ranges, as described above).

FIG. 4 depicts a mechanical, spring-based embodiment of the power generator (36), in which the body portion (12) of the tool, pressure transducer assembly (16), circuit board (38), microprocessor (40), acceleration sensor (42), and temperature sensor (44) are shown. The depicted power generator (36) includes a spring housing (56), which contains an internal, mechanically windable spring, associated with a solenoid (58). In use, the spring can be wound at the surface, then actuation of the solenoid (58) can be used to release spring to power the generator (46), which in turn powers the circuit board (38) and the components associated therewith. Any number and/or manner of gearbox, shaft, and/or transmission can be used to transfer power from the spring to the generator (46), as needed.

Figure 5:
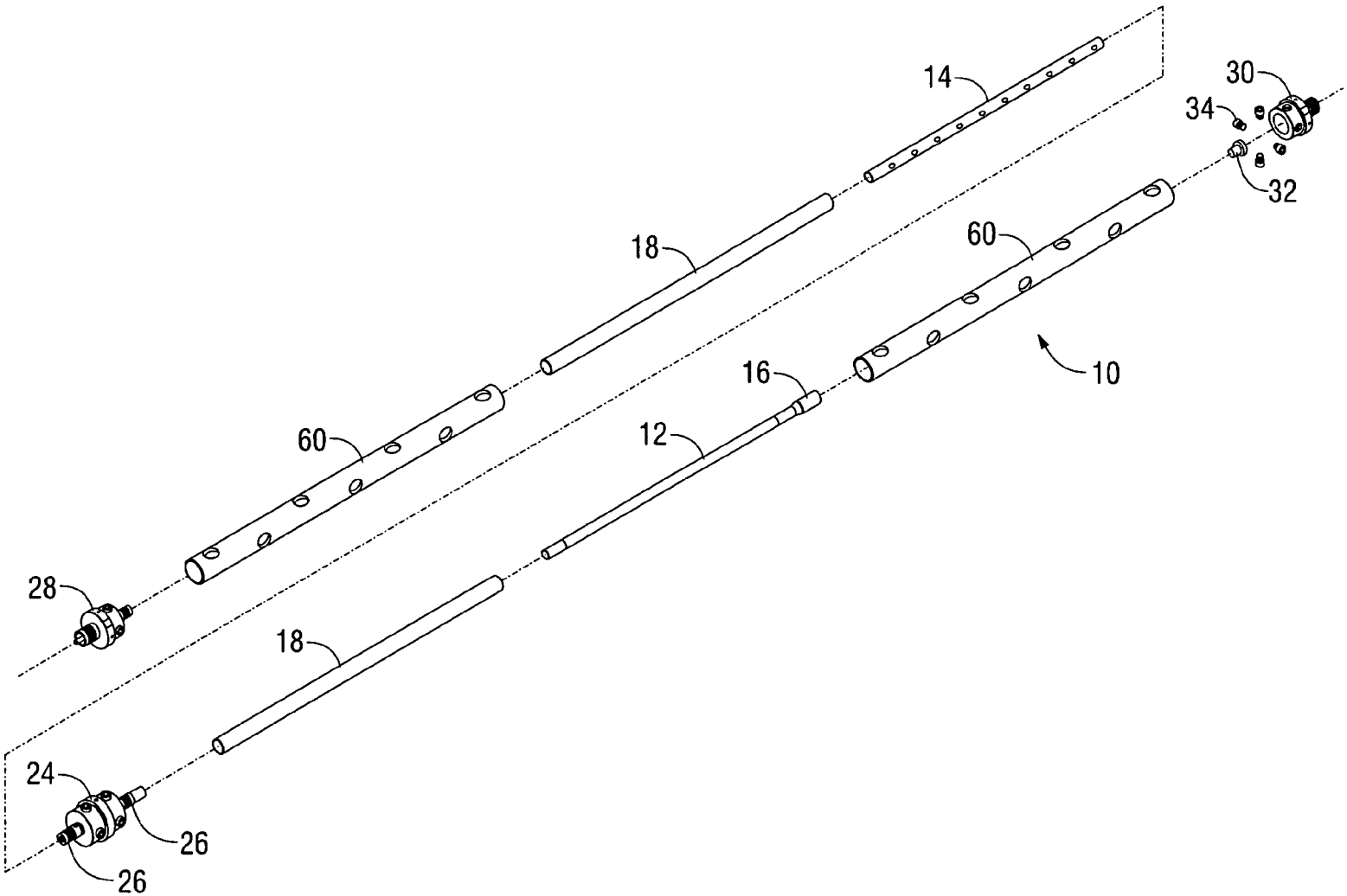
FIG. 5 depicts an exploded view of an alternate embodiment of the actuation tool of FIG. 1.

Referring now to FIG. 5, an exploded view of an alternate embodiment of the actuation tool (10) of FIG. 1 is shown, having the body members (12, 14) containing the processor, circuit board, pressure transducer assembly (16), and power source (e.g., batteries), as described previously, two inner housing members (18) sized to be positioned over the body members (12, 14), and two outer housing members (60) sized to be positioned over the inner housing members (18). FIG. 5 also depicts the bottom connector (28), top connector (30), central connector (24) having ends (26), transducer plug (32), and socket head screws (34), as described above.

In contrast to the embodiment shown in FIG. 1, the tool (10) of FIG. 5 includes alternate outer housing members (60), which are sized for insertion into a smaller conduit. Specifically, the depicted outer housing members (60) have a diameter of 1.5 inches, while the outer housing members (20) of FIG. 1 have a diameter of 2.5 inches. The central, top, and bottom connectors (24, 28, 30) are also shown having a diameter sized for engagement and use with the depicted outer housing members (60). It should be understood that embodiments of the present tool (10) can be provided with housing members and/or connectors of multiple sizes, which can be installed and removed, as needed, to accommodate conduits, wellbores, and/or restrictions of various diameters. Additionally, it should be noted that while FIG. 5 depicts an embodiment of the tool (10) that includes a second body portion (14) and associated housing members (18, 60) for containing batteries and/or a similar power source, the depicted embodiment could also be used with an in situ power generator, and the second body portion (14), central connector (24), and bottommost housing members (18, 60) could be omitted.

Figure 6:
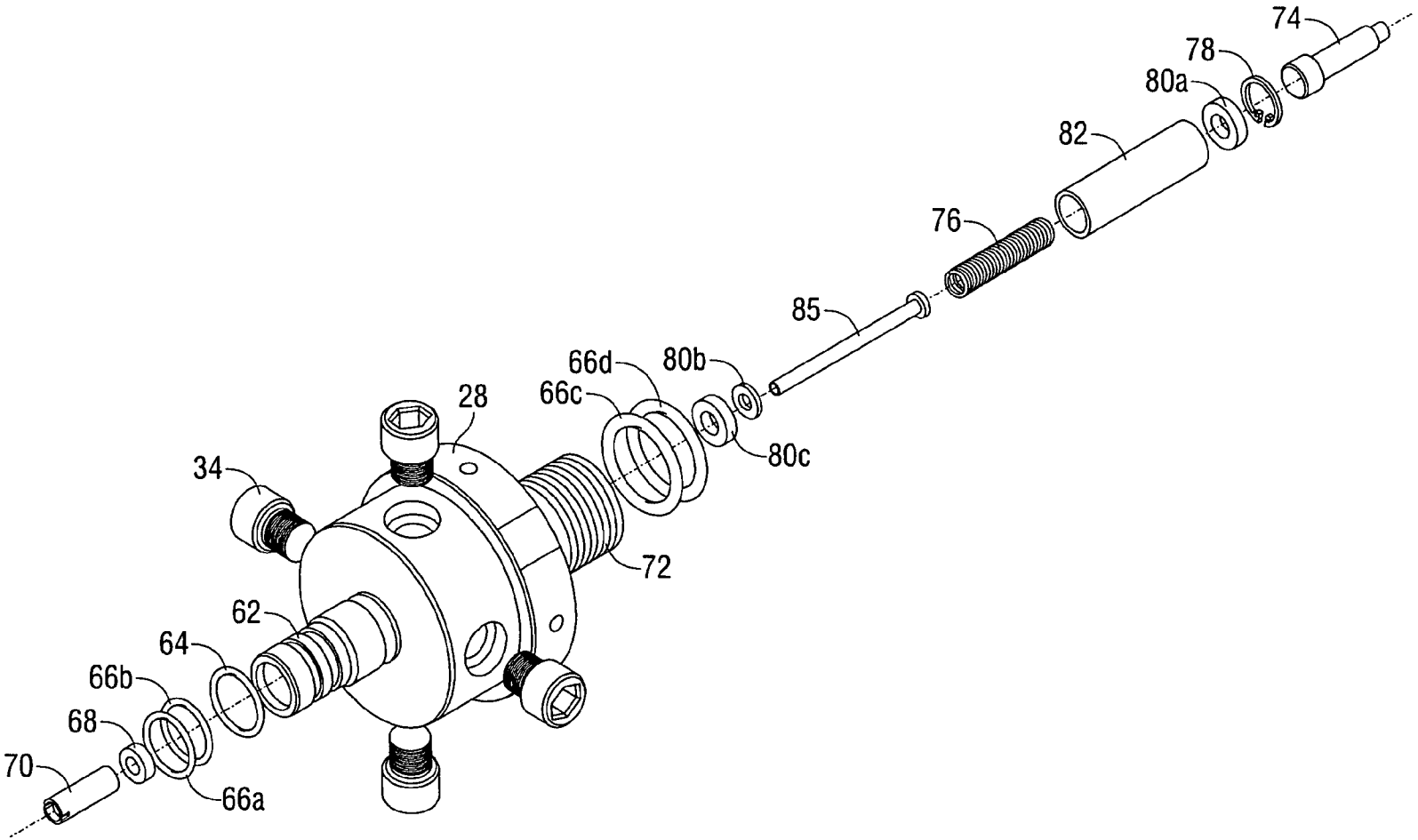
FIG. 6 depicts an exploded view of an embodiment of a bottom connector usable with the actuation tool of FIG. 1.

Referring now to FIG. 6, an exploded view of an embodiment of a bottom connector (28), usable with the tool of FIG. 1, is shown. It should be noted that a bottom connector (28) having a differing diameter could be used with other embodiments of the tool, such as that shown in FIG. 5, or in embodiments of the tool used without outer housing members. As described previously, the bottom connector (28) can be attachable to the remainder of the tool using a plurality of socket head cap screws (34) or similar fastening elements. Alternately, the bottom connector (28) could be attached to the remainder of the tool via a force or interference fit, a threaded connection, welding, or any other means known in the art. The upper end (62) of the connector (28) is depicted having multiple receptacles for accommodating a grounding spring (64) (e.g., a garter spring) and/or one or more O-rings (66*a*, 66*b*) or similar sealing elements. An insulator (68) and receptacle (70) (e.g., a banana receptacle) are also associated with the upper end (62) for electrical contact and/or engagement with the adjacent portions of the tool (e.g., the power source and/or the circuit board). The lower end (72) of the connector (28) is also shown having grooves for accommodating O-rings (66*c*, 66*d*) or similar sealing elements. The lower end (72) also includes an associated contact plunger (74), biased outward by a contact spring (76), for association with adjacent objects and/or for receiving pressure from the wellbore and transmitting the pressure to a pressure transducer within the tool. The plunger (74) is shown configured and/or positioned by a retainer ring (78), insulating washer (80*a*), and a contact insulator (82) which surrounds the spring (76). The upper end of the spring (76) is shown associated with a pan head screw (85) or similar rigid fastening element, which in turn passes through one or more washers and/or insulated washers (80*b*, 80*c*) before engaging the body of the connector (28).

Figure 7:
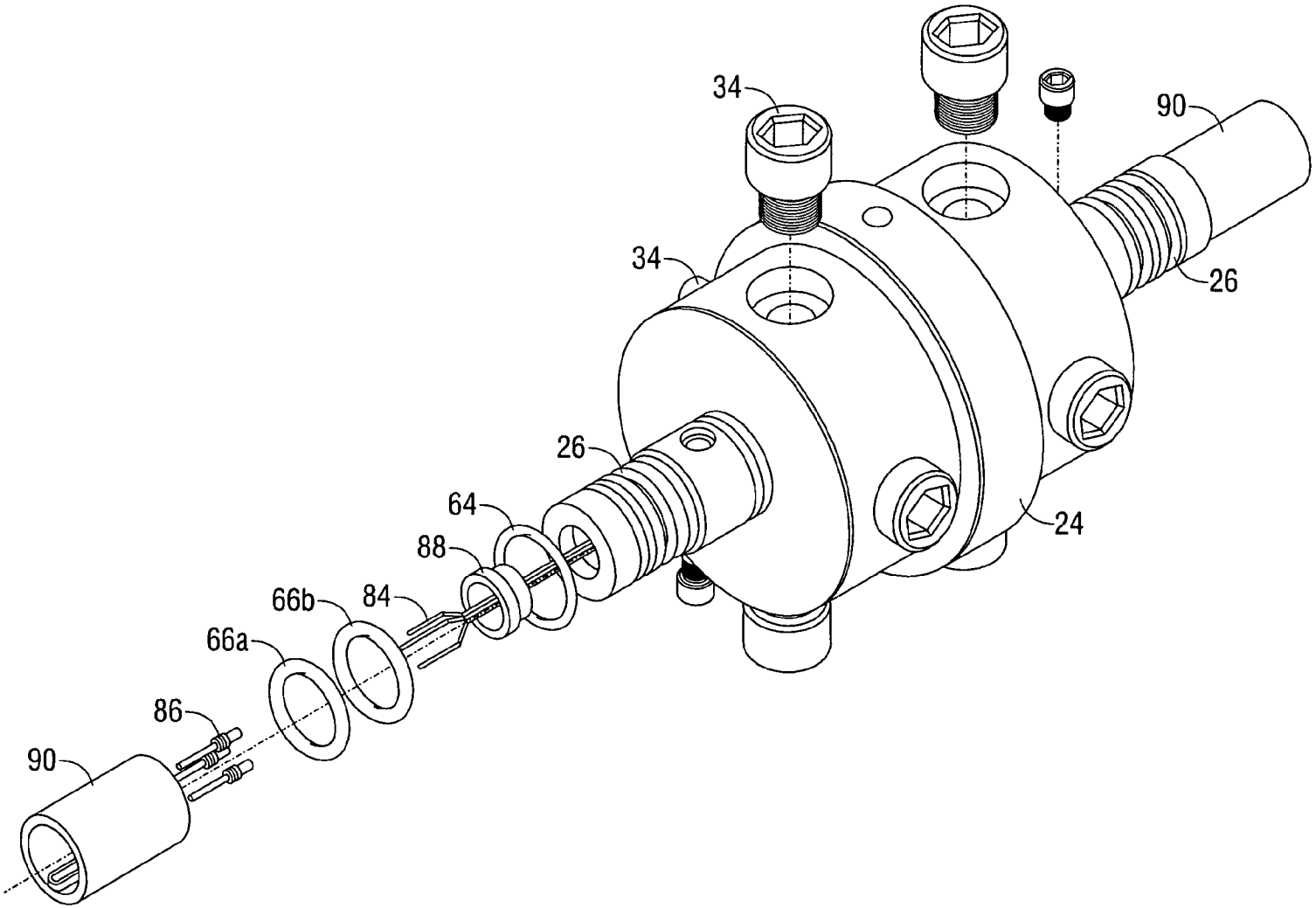
FIG. 7 depicts an exploded view of an embodiment of a central connector usable with the actuation tool of FIG. 1.

Referring now to FIG. 7, an exploded view of an embodiment of a central connector (24), usable with the tool of FIG. 1, is shown. It should be noted that a central connector (24), having a differing diameter, could be used with other embodiments of the tool, such as that shown in FIG. 5, or in embodiments of the tool used without outer housing members. The depicted connector (24) is shown having each end (26) associated with two sets of socket head cap screws (34); specifically, each inner set of screws (34) is usable to secure the connector (24) to adjacent outer housing portions of the tool, while each outer set of screws (34) is usable to secure the connector (24) to adjacent inner housing and/or body portions of the tool. Alternatively and/or additionally, the connector (24) could be attached to the remainder of the tool via a force or interference fit, a threaded connection, welding, or any other means known in the art.

Each end (26) of the connector (24) can include substantially identical components, and as such, a single end (26) of the connector (24) is shown in exploded view for reference. The end (26) includes grooves for accommodating a grounding spring (64) (e.g., a garter spring) and/or one or more O-rings (66*a*, 66*b*) or similar sealing elements. A three-prong wire (84) (e.g., Teflon coated wire) can extend through the connector (24), terminating in a three-pin male connector (86), thus providing electrical communication through the connector (24), e.g., to enable transmission of power between one or more batteries and the circuit board, and/or to enable transmission of data and/or power between other components of the tool. An adapter plug (88) is also shown engaged with the end (26) of the connector (24) for accommodating engagement with adjacent components (e.g., the inner housing and/or body members of the tool), via a box connector (90).

Figure 8:
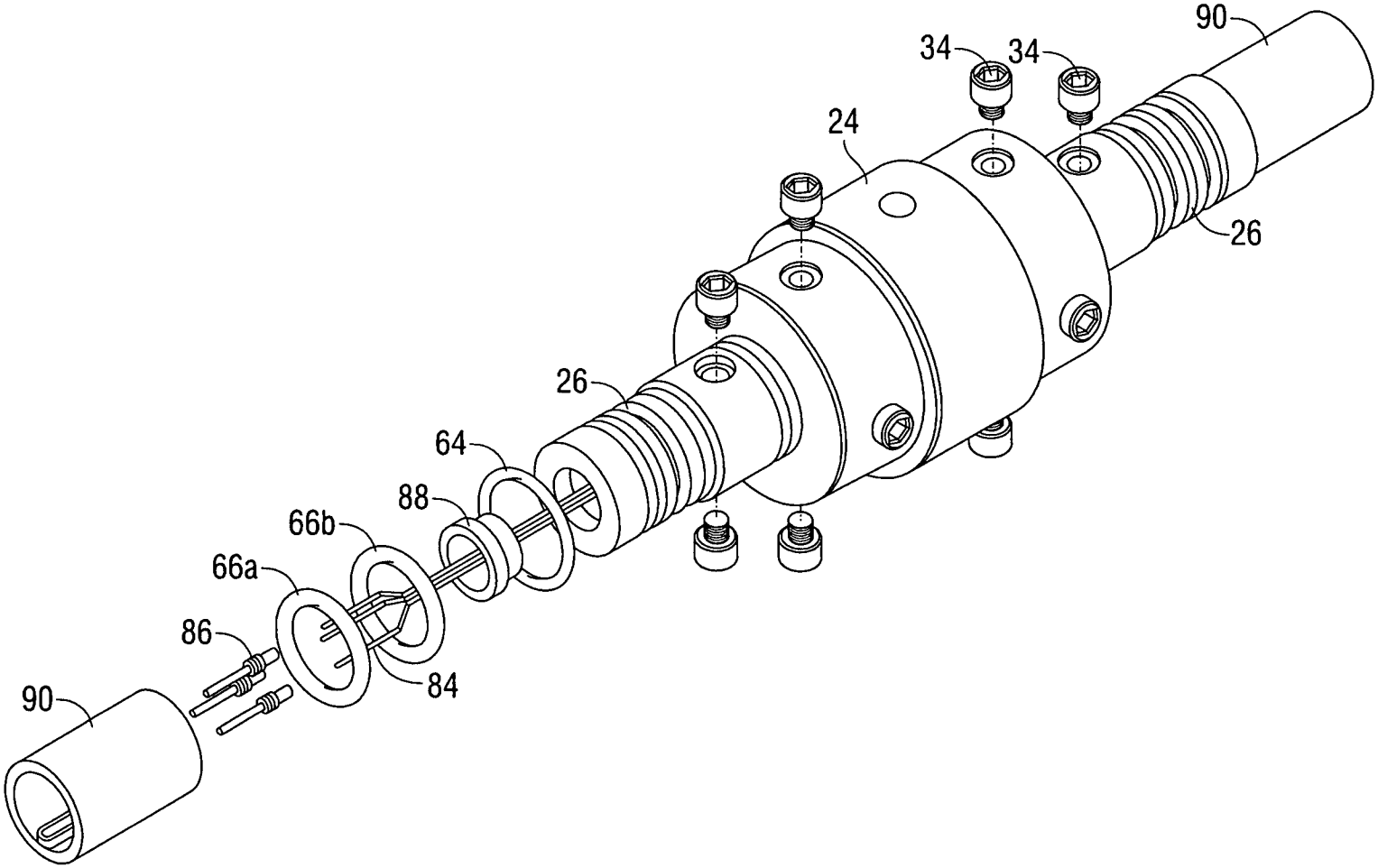
FIG. 8 depicts an exploded view of an embodiment of a central connector usable with the actuation tool of FIG. 5.

As described above, the dimensions and/or shape of the connector (24) can vary depending on the dimensions (e.g., the diameter) of the outer and inner housing members, if used, and/or the dimensions of the tool body. For example, FIG. 8 depicts an exploded view of an embodiment of a central connector (24) having substantially identical components as those of the embodiment of the connector (24) shown in FIG. 7; however, the body of the connector (24), the socket head cap screws (34), and other components have been sized to accommodate a tool that includes outer housing members having a diameter of 1.5 inches. Conversely, the embodiment of the connector (24) shown in FIG. 7 is adapted for engagement with a tool that includes outer housing members having a diameter of 2.5 inches.

Figure 9:
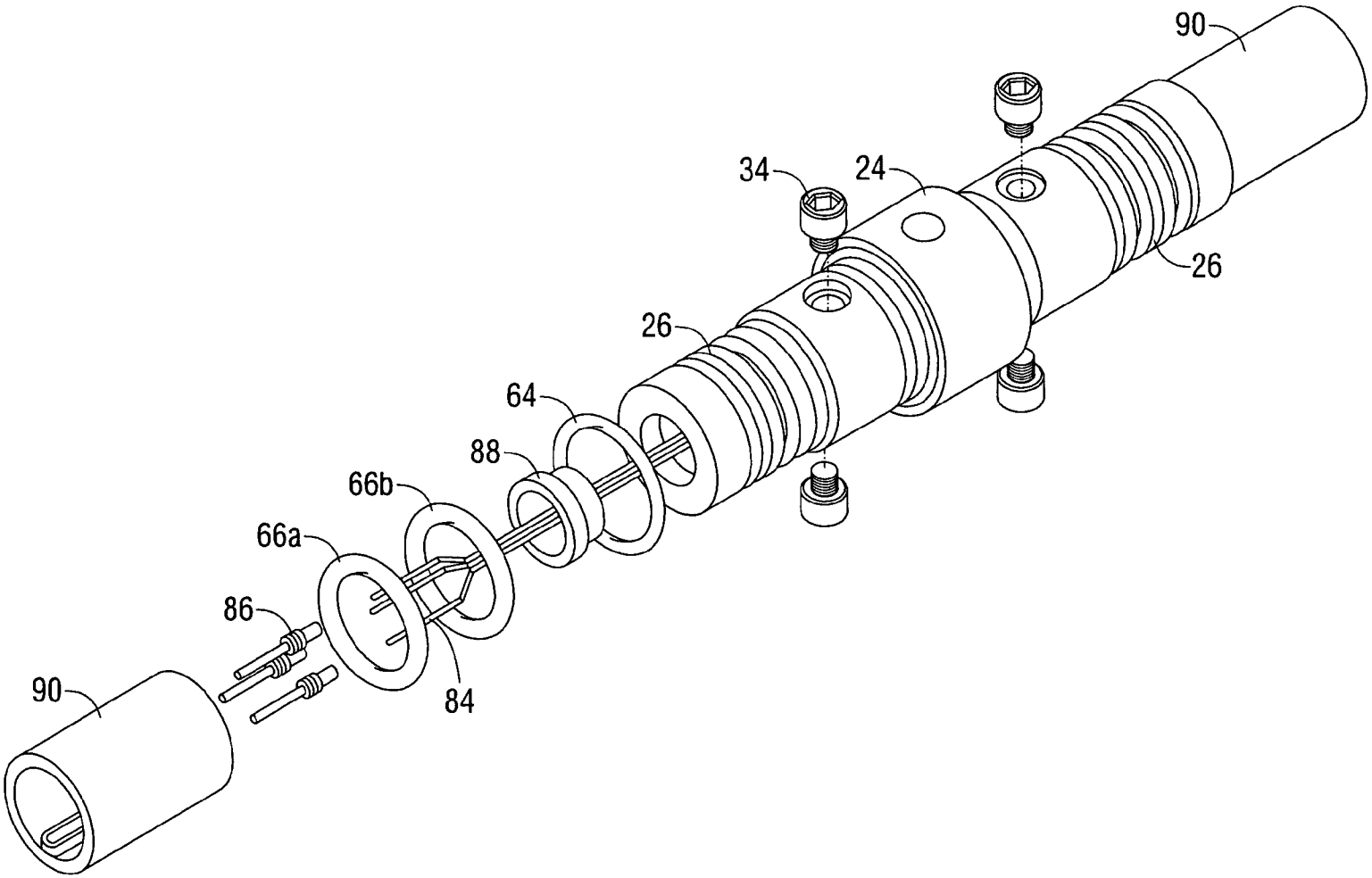
FIG. 9 depicts an exploded view of an alternate embodiment of a central connector usable within the scope of the present disclosure.

Similarly, FIG. 9 depicts an exploded view of an embodiment of a central connector (24) having substantially identical components as those of the embodiment of the connector (24) shown in FIGS. 7 and 8; however, the body of the connector (24) and other components have been sized to accommodate a tool having a diameter of 0.875 inches, e.g., a tool that does not include outer housing members. As such, only a single set of socket head cap screws (34) is shown, for providing engagement between the connector (24) and the inner housing members and/or body portions of the tool.

Figure 10:
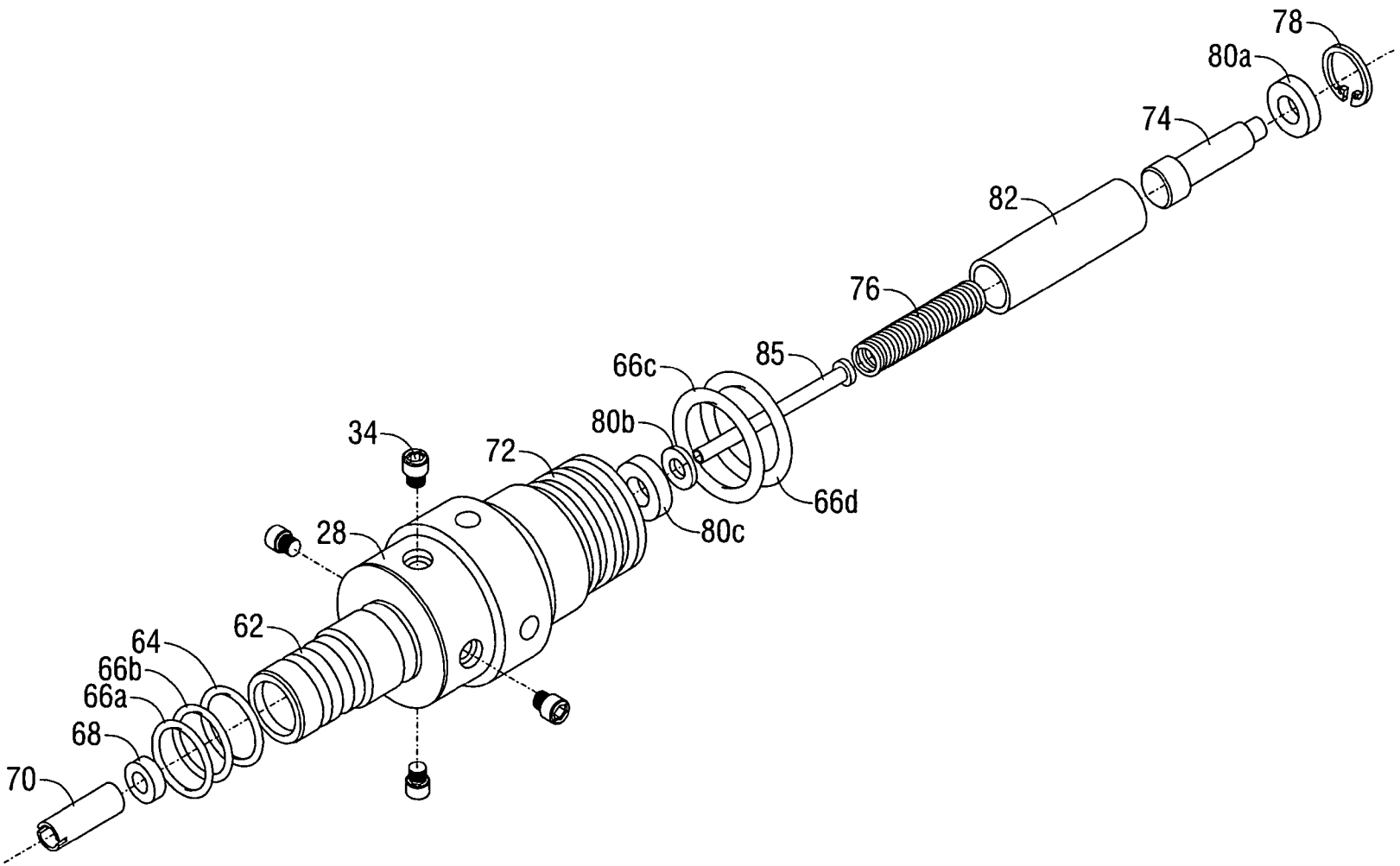
FIG. 10 depicts an exploded view of an embodiment of a bottom connector usable with the actuation tool of FIG. 5.

In a similar manner, the shape and/or dimensions of the bottom connector (28) can vary depending on the dimensions (e.g., the diameter) of the outer and inner housing members, if used, and/or the dimensions of the tool body. For example, FIG. 10 depicts an exploded view of an embodiment of a bottom connector (28) having substantially identical components as those of the embodiment of the connector (28) shown in FIG. 6. However, the body of the connector (28), the socket head cap screws (34), and other components have been sized to accommodate a tool that includes outer housing members having a diameter of 1.5 inches. Conversely, the embodiment of the connector (28) shown in FIG. 6 is adapted for engagement with a tool that includes outer housing members having a diameter of 2.5 inches.

Figure 11:
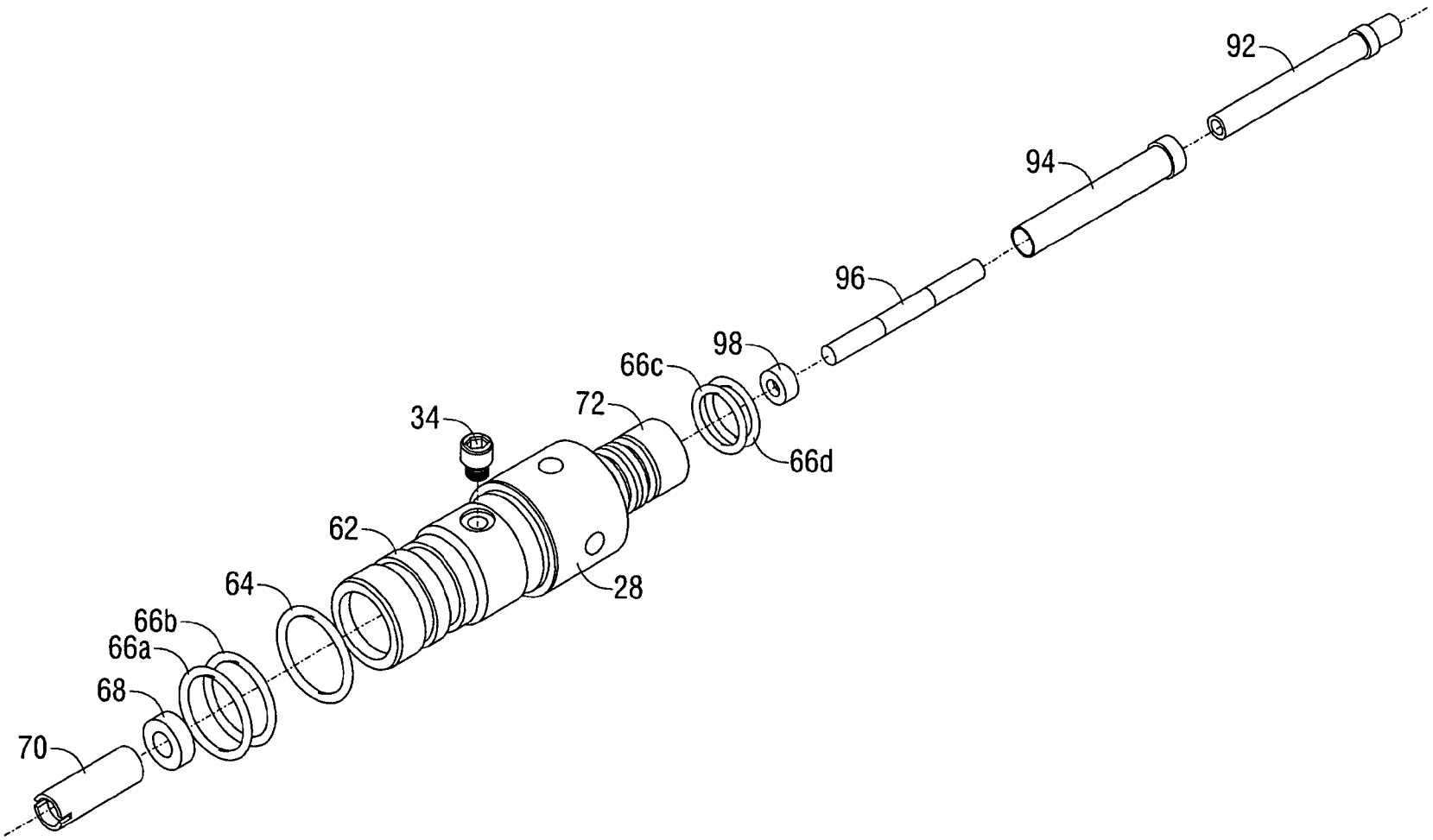
FIG. 11 depicts an exploded view of an alternate embodiment of a bottom connector usable within the scope of the present disclosure.

FIG. 11 depicts an exploded view of an embodiment of a bottom connector (28) similar to those shown in FIGS. 6 and 10; however the body of the connector (28) and other components have been sized to accommodate a tool having a diameter of 0.875 inches, e.g., a tool that does not include outer housing members. As such, while the upper end (62) of the connector (28) includes a grounding spring (64), O-rings (66*a*, 66*b*), an insulating washer (68), and a receptacle (70) (e.g., a banana receptacle), the components engaged with the lower end (72) of the connector (28) differ from the embodiments shown in FIGS. 6 and 10. Specifically, in addition to one or more O-rings (66*c*, 66*d*), the lower end (72) of the connector (28) can include a spring loaded contactor (92) (e.g., a biased plunger), which is insertable within an insulator (94), and can engage a threaded connector rod (96) for engagement with the body of the connector (28) and/or with adjacent components of the tool. The connector rod (96) can pass through and/or otherwise engage an insulator (98), such as a washer or similar component.

Figure 12:
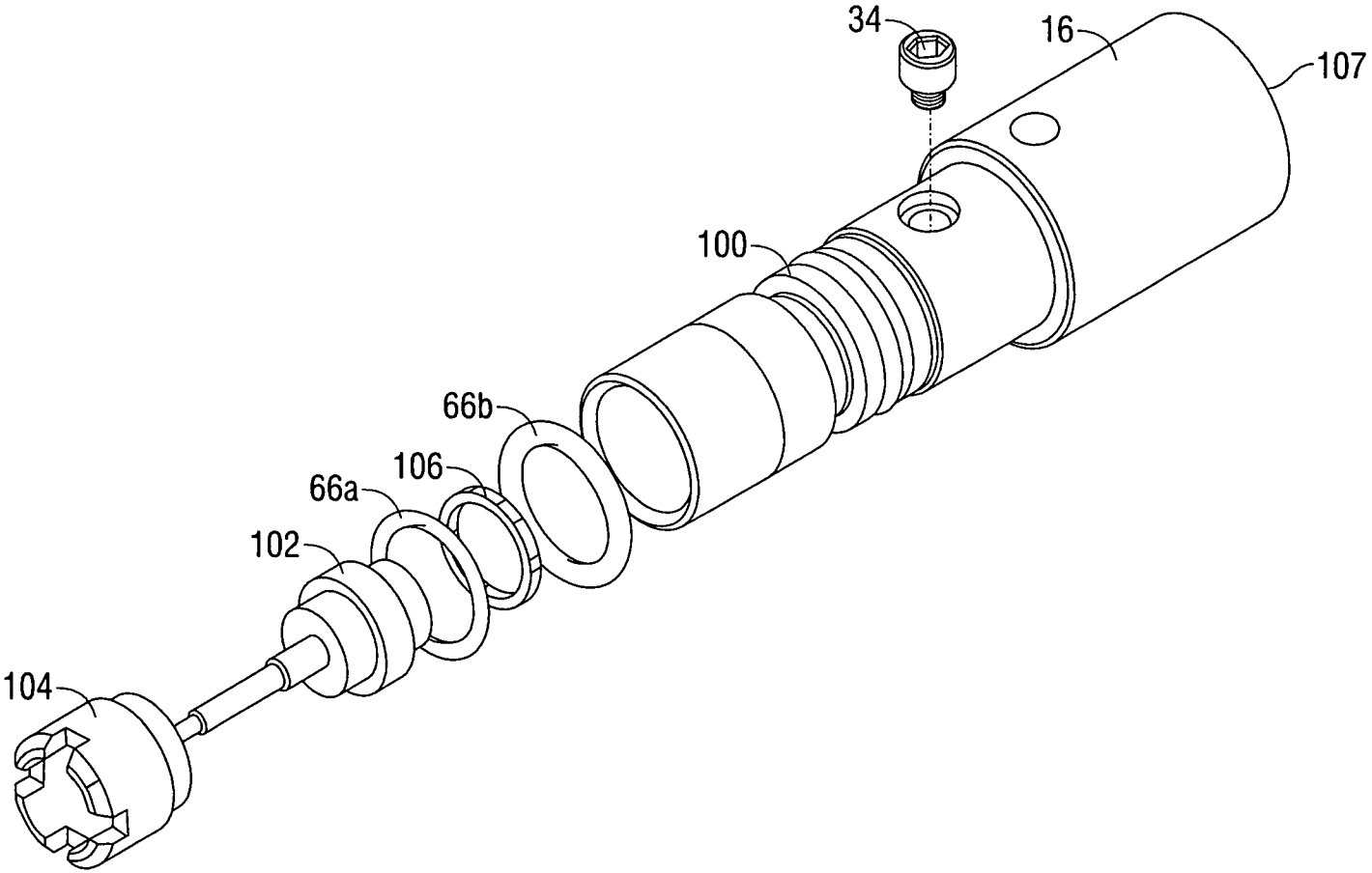
FIG. 12 depicts an exploded view of an embodiment of a sensor assembly usable with the actuation tool of FIGS. 1 and 5.

Referring now to FIG. 12, FIG. 12 depicts an exploded view of an embodiment of the pressure transducer assembly (16), usable with the actuation tools shown in FIGS. 1 and 5, and/or with other embodiments of the present actuation tool. As shown in FIGS. 1 and 5, the pressure transducer assembly (16) is engageable with an end of the body of the tool, such that a pressure transducer (102) is placed in association with the processor and/or other circuitry of the tool. The depicted pressure transducer (102) includes a retaining unit (104) adapted to engage a corresponding member and/or portion of the tool body such that the pressure transducer (102) is retained in association with the processor and/or circuit board. Specifically, the pressure transducer assembly (16) can be secured to the tool body using socket head cap screws (34) and/or similar fasteners, or in an embodiment, a force or interference fit, a threaded connection, welding, and/or any other means known in the art. The end (100) of the pressure transducer assembly (16) includes grooves for accommodating O-rings (66*a*, 66*b*) or similar sealing elements, while the interior of the assembly (16) can be sized to engage and/or accommodate a crush washer (106) or similar spacing member, which can in turn engage the pressure transducer (102). When assembled, pressure transmitted through the lower end (107) of the assembly (16), e.g., through the bottom connector and/or other portions of the tool, is communicated to the pressure transducer (102), which measures the pressure and communicates the measured data to the processor and/or data storage of the tool. While the depicted pressure transducer assembly (16) is shown as a generally tubular (e.g., cylindrical) component, having a diameter of approximately 0.875 inches for engaging a tool body having a similar diameter, it should be understood that the dimensions of the assembly (16) can be varied depending on the corresponding dimensions of other portions of the actuation tool.

Figure 13:
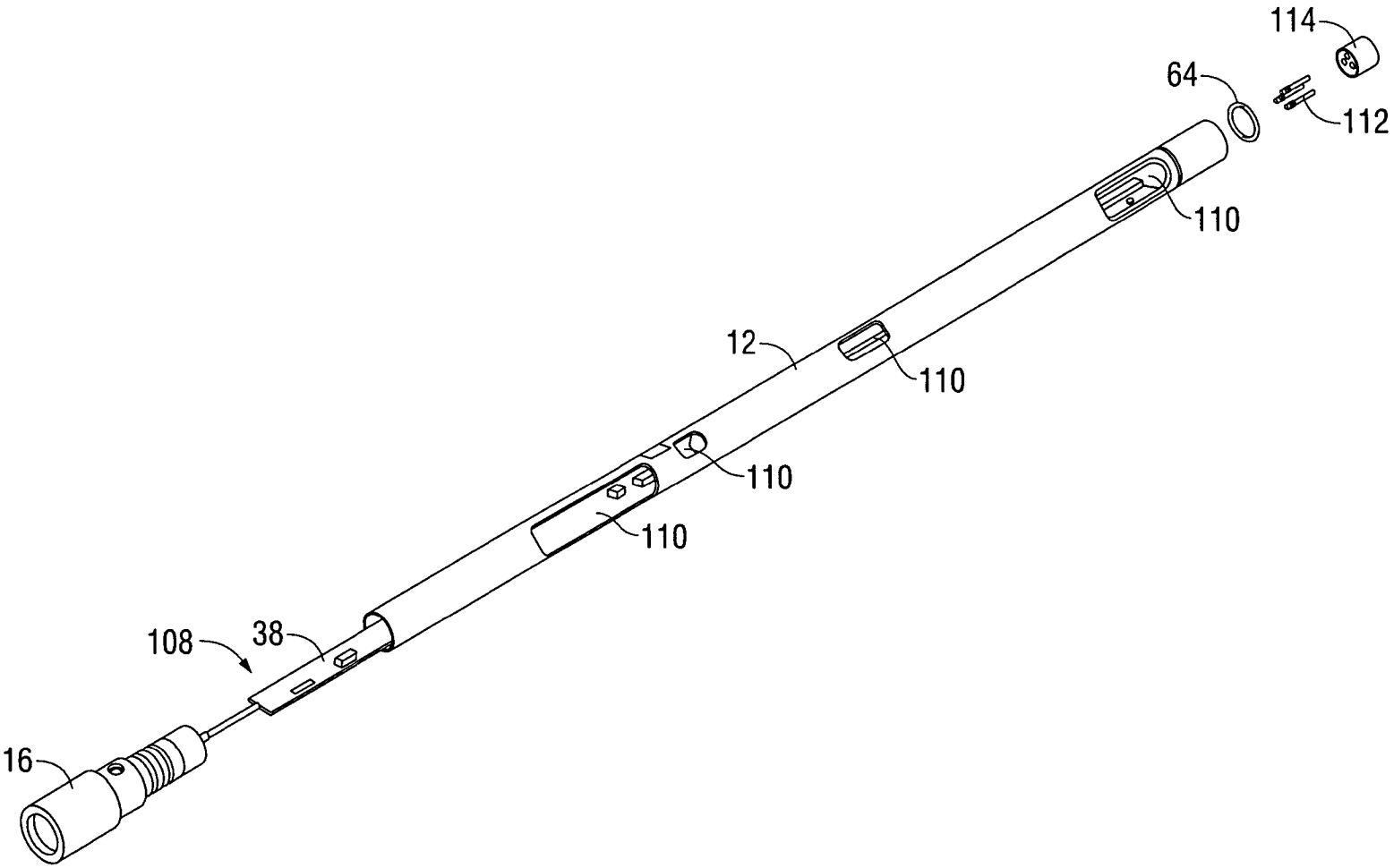
FIG. 13 depicts an exploded view of an embodiment of a portion of an actuation tool usable within the scope of the present disclosure.

Referring now to FIG. 13, an exploded view of an embodiment of a tool body portion (12), such as that shown in actuation tool (10) of FIG. 1 or FIG. 5, is depicted. Specifically the tool body portion (12) is shown having a generally tubular body with various openings (110) formed therein, to enable light emitting diodes and/or other indicators, portions of the circuit board (38), and/or other components or portions thereof to be visualized, and also to enable the communication of gas and/or temperature to the sending components of the tool (10). The pressure transducer assembly (16) is shown engaged at one end of the tool portion (12) with the circuit board (38) for communicating data therebetween. At the opposing end of the tool portion (12), a grounding spring (64) is engaged (e.g., within an interior or exterior groove within the body of tool portion (12)). A female three-pin connector (112) is also provided, e.g., for engagement with a corresponding three-pin male connector within the adjacent central connector, and/or another adjacent component. The depicted pin connector (112) includes an end piece (114) associated therewith.

Figure 14:
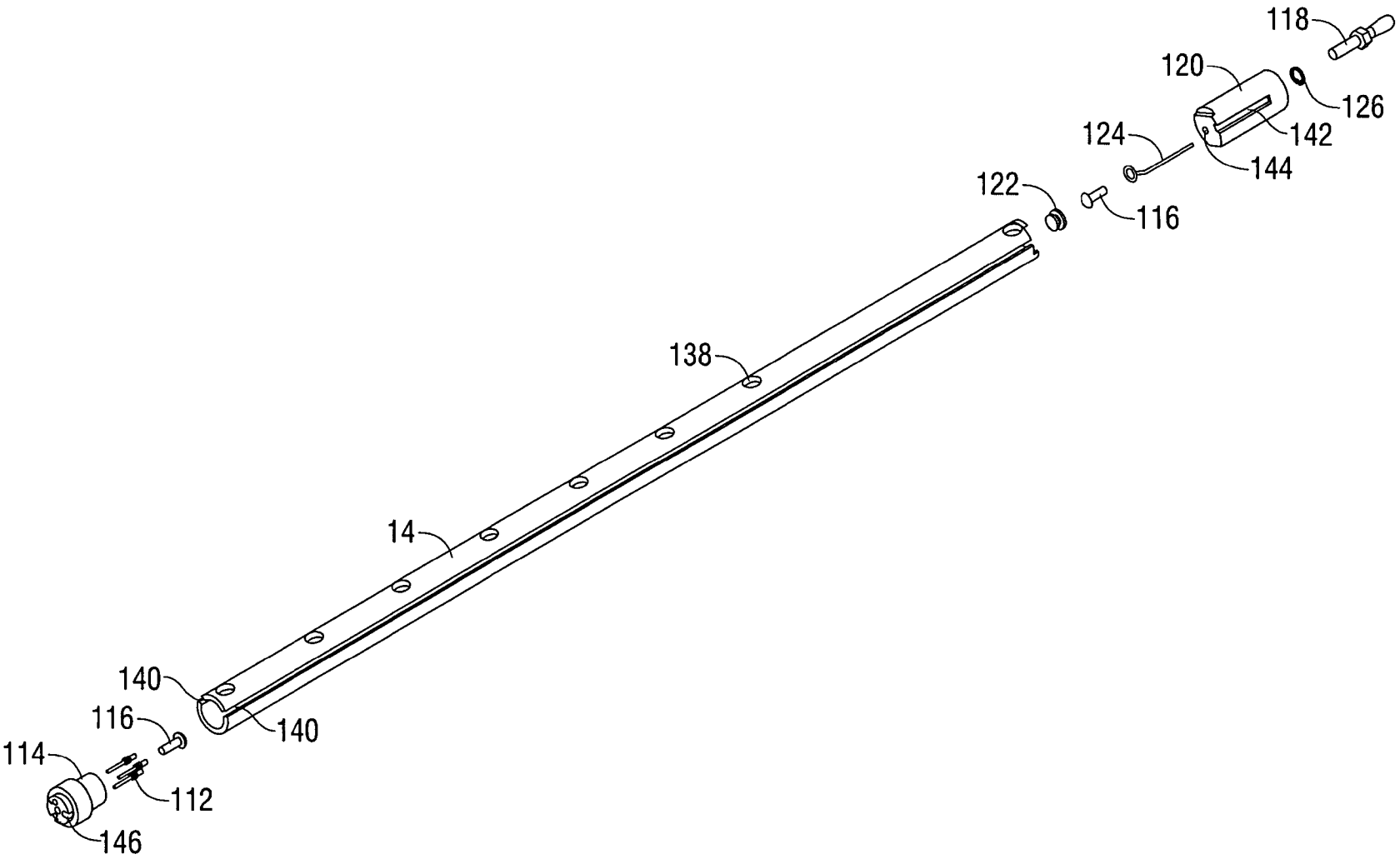
FIG. 14 depicts an exploded view of an embodiment of a portion of an actuation tool usable within the scope of the present disclosure.

Referring now to FIG. 14, an exploded view of an embodiment of a tool portion (14), such as that shown in actuation tool (10) of FIG. 1 or FIG. 5, is depicted. The depicted tool portion is usable to contain one or more batteries (e.g., AAA batteries) and/or other power sources therein, for engagement with other portions of the actuation tool (e.g., the circuit board, processor, and/or sensors). In an embodiment, one or more inserts can be provided into the tool portion (14) to facilitate proper spacing and/or positioning of batteries or other power sources. A first end of the tool portion (14) is engaged, via a screw (116) (e.g., a button head cap screw), to a female three-pin connector (112) and associated end piece (114), which can be used to engage and provide electrical communication with adjacent components (e.g., a male connector within a bottom connector, a probe and/or power tool, or other components having a portion adapted to engage the female three-pin connector (112)). The depicted end piece (114) is shown having three bores (146) therein for accommodating the individual pins of the pin connector (112), and can also include a central hole extending at least partially therethrough, e.g., for accommodating the screw (116). At the opposing end of the tool portion (14), a plug (118) (e.g., a banana plug), battery connector (120), and battery spring (122) are secured, e.g., using a screw (116) or similar means of fastening. FIG. 14 also depicts a wire ground spring (124) and solder lug (126) to provide appropriate grounding and/or spacing of components within the tool portion (14) (e.g., the wire ground spring (124) can be positioned through a bore (144) within the battery connector (120) to engage the solder lug (126) and/or the battery plug (118)); however, it should be understood that other such elements can be used in various embodiments, and/or that such elements could be omitted without departing from the scope of the present disclosure.

The depicted housing of the tool portion (14) is shown having a plurality of orifices (138) formed therein, which can be used to visually verify the presence of batteries or other internal elements, for engagement with fasteners (e.g., socket head cap screws), and/or to communicate gas and/or temperature. The housing is also shown having grooves and/or channels (140) formed on the outer surface thereof, which, in an embodiment, can be engaged with corresponding protruding elements of a housing component (e.g., inner housing member (18)), adapted for being placed over the tool portion (14). Additionally or alternatively, the grooves and/or channels (140) can define internal protrusions within the tool portion (14) housing, which can engage complementary channels (142) within the battery connector (120). While FIG. 14 shows a channel (142) within the battery connector (120) that extends partially along the length thereof, in other embodiments, such channels could extend across the entire length thereof to enable insertion of the entirety of the battery connector (120) within the tool portion (14).

Embodiments usable within the scope of the present disclosure also include kits usable to monitor (e.g., log) a wellbore and/or actuate a downhole device, which can include one or more embodiments of the actuation tools described above. For example, an actuation tool can be provided that includes multiple sizes of housing members, such that the tool can be configured, as needed, for insertion into wellbores and/or conduits of various sizes and/or having various internal restrictions therein. One or more tools (e.g., wrenches, etc.), fasteners (e.g., socket head cap screws), and similar components for reconfiguring the actuation tool can also be included, as can a display and/or input device for accessing and programming the actuation tool, and various calibration and/or testing components for testing and/or calibrating one or more sensors within the tool.

Figure 15:
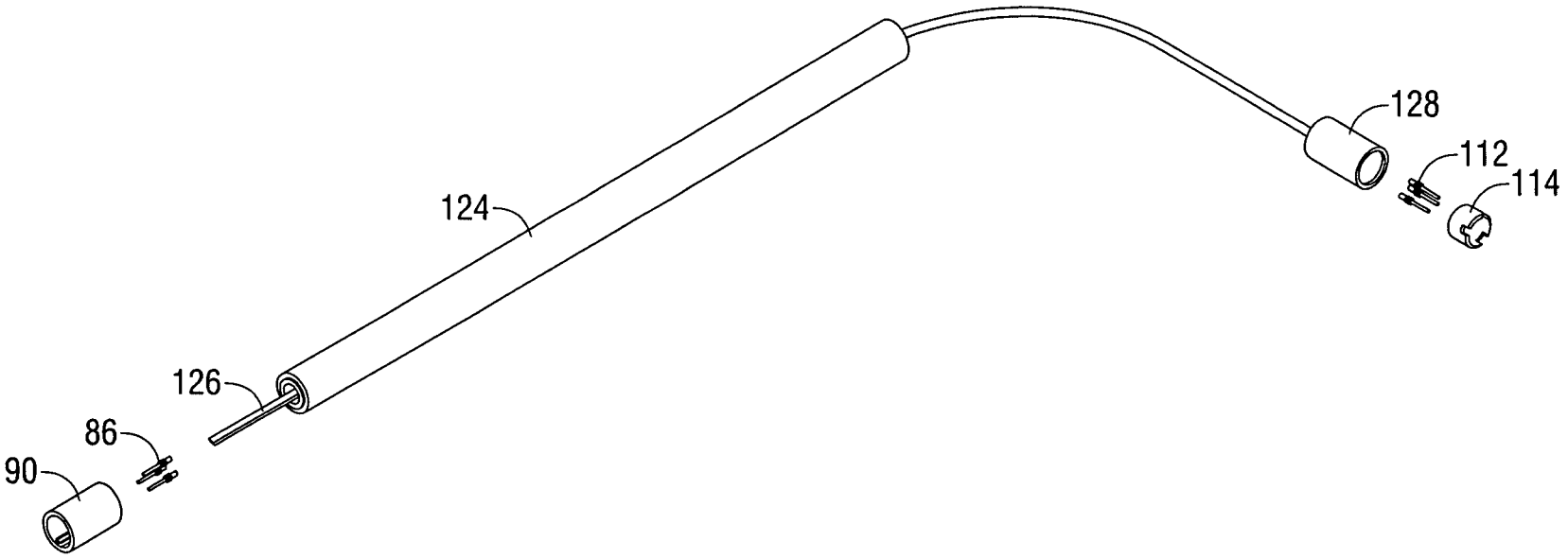
FIG. 15 depicts an exploded view of an embodiment of a power connector and/or probe assembly usable with embodiments of actuation tools usable within the scope of the present disclosure.

For example, FIG. 15 depicts an exploded view of an embodiment of a power connector and/or probe assembly (124) usable within embodiments of the present actuation tool, such as those depicted in FIGS. 1 and 5. The depicted assembly (124) is shown including probe connector wire (126) extending through the body thereof, with a male three-pin connector (86) and box connector (90) at one end thereof, and a female three-pin connector (112) having an end piece (114) and housing (128) associated therewith. The probe assembly (124) is usable as a conduit to provide power to the actuation tool, verify the charge of power sources within the actuation tool, to communicate between the actuation tool and a display and/or input device, and for various other purposes where a generally flexible connector and/or conduit may be desirable to communicate between components.

Figure 16:
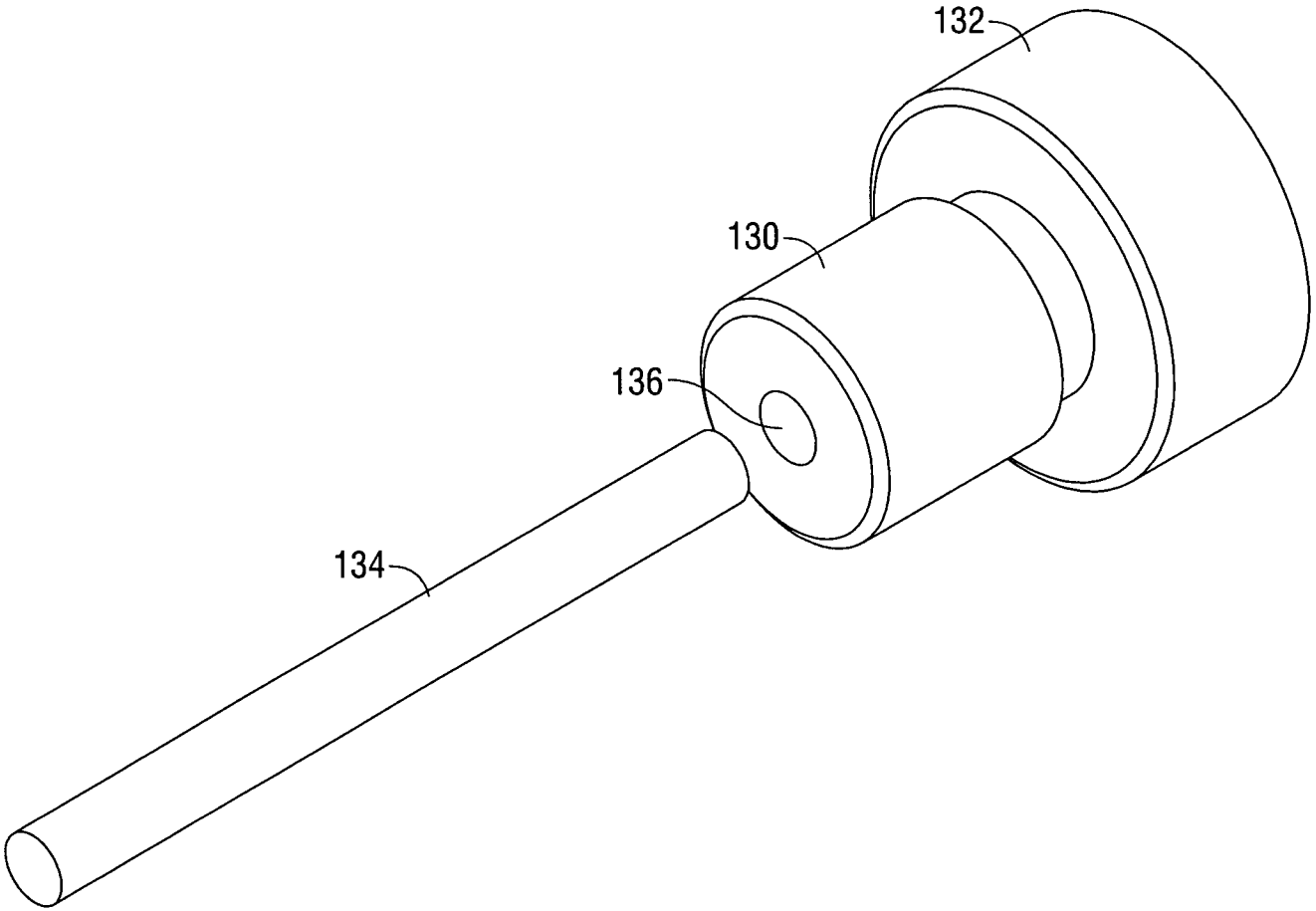
FIG. 16 depicts an exploded view of an embodiment of a pressure simulation tool assembly usable with embodiments of actuation tools usable within the scope of the present disclosure.

FIG. 16 depicts an exploded view of an embodiment of a pressure simulation tool assembly (130), usable to calibrate and/or test the functionality of a pressure sensor of an actuation tool, such as the pressure transducer assembly described above. In use, a threaded end (132) of the pressure simulation tool assembly (130) can be threaded to and/or otherwise engaged with the pressure transducer assembly of an actuation tool, while a rod (134) can be inserted into a corresponding bore (136) of the assembly (130), such that the rod (134) applies a pressure to the pressure sensor and/or causes the body of the assembly (130) to apply a pressure to the pressure sensor. While FIG. 16 depicts the rod (134) and bore (136) having generally smooth surfaces, embodied pressure simulation tools can include threaded and/or adjustable engagements between components to enable a controlled and/or precise application of pressure to an actuation tool.

While various embodiments usable within the scope of the present disclosure have been described with emphasis, it should be understood that within the scope of the appended claims, the present invention can be practiced other than as specifically described herein.

What is claimed is:

1. A system for monitoring a wellbore and actuating a downhole device, the system comprising:

an elongate body adapted for insertion into the wellbore;

a processor within the elongate body;

a first sensor within the elongate body and in communication with the processor, wherein the first sensor detects a pressure associated with the elongate body;

a second sensor within the elongate body and in communication with the processor, wherein the second sensor detects a temperature associated with the elongate body;

a third sensor within the elongate body and in communication with the processor, wherein the third sensor detects an acceleration associated with the elongate body; and data storage within the elongate body and in communication with the processor, wherein the data storage comprises computer instructions for instructing the processor to:

receive and store a first preselected parameter comprising a pressure range;

receive and store a second preselected parameter comprising a temperature range;

receive and store a third preselected parameter comprising an acceleration range;

receive and store the pressure, the temperature, and the acceleration from the first sensor, the second sensor, and the third sensor, respectively;

compare the pressure, the temperature, and the acceleration with the pressure range, the temperature range, and the acceleration range, respectively, to form a determination;

initiate an actuation process responsive to the determination;

receive and store a failsafe temporal parameter comprising a failsafe duration; and prevent initiation of the actuation process after the failsafe duration has elapsed.

2. The system of claim 1, wherein the elongate body comprises an inner member having a first diameter, and an outer housing having a second diameter greater than the first diameter, wherein loads applied to the elongate body are distributed along the outer housing.

3. The system of claim 2, wherein the outer housing comprises an insulated member adapted to minimize transfer of heat between the wellbore and a power source within the elongate body for prolonging the usable life of the power source.

4. The system of claim 1, wherein the elongate body comprises a diameter sized for insertion into coiled tubing, a pipe having a diameter of 5 cm or less, or combinations thereof.

5. The system of claim 1, wherein the computer instructions for instructing the processor to initiate the actuation process responsive to the determination further comprise computer instructions for instructing the processor to:

receive and store a first preselected temporal parameter comprising a first duration;

compare the pressure, the temperature, and the acceleration with the pressure range, the temperature range, and the acceleration range, respectively, for the first duration to form the determination;

receive and store a second preselected temporal parameter comprising a second duration; and actuate the downhole device associated with the elongate body after the second duration has elapsed.

6. The system of claim 5, wherein the computer instructions for instructing the processor to actuate the downhole device associated with the elongate body after the second duration has elapsed further comprise computer instructions for instructing the processor to:

compare the pressure, the temperature, and the acceleration with the pressure range, the temperature range, and the acceleration range, respectively, during the second duration, to form an additional determination; and cease the actuation process responsive to the additional determination.

7. The system of claim 1, further comprising a power source within the elongate body, wherein the power source comprises at least one fuel cell.

8. The system of claim 1, further comprising a power source associated with the elongate body, wherein the power source comprises an in situ power generator.

9. The system of claim 8, wherein the in situ power generator comprises:

a windable spring associated with a downhole device, wherein unwinding of the spring causes actuation of the downhole device; and a release mechanism in communication with the windable spring, wherein the release mechanism prevents unwinding of the spring until the release mechanism is actuated to release the windable spring, and wherein initiation of the actuation process releases the windable spring.

10. The system of claim 8, wherein the in situ power generator comprises:

a movable member associated with a downhole device and a fluid flowpath, wherein fluid in the fluid flowpath causes movement of the movable member, and wherein movement of the movable member causes actuation of the downhole device.

11. The system of claim 1, wherein the elongate body comprises:

a first member having a first end, a second end, and a power source disposed therein;

a connector engaged with the first end of the first member; and a second member engaged with the connector.

12. The system of claim 11, wherein the connector comprises at least one grounding spring positioned about a circumference thereof between the connector and the first member, between the connector and the second member, or combinations thereof.

13. The system of claim 11, further comprising at least one end member engaged with the second end of the first member, with the second member, or combinations thereof, wherein said at least one end member comprises at least one grounding spring positioned about a circumference thereof.

14. The system of claim 1, wherein the elongate body comprises a length ranging from 30 inches to 50 inches.

15. The system of claim 1, wherein the elongate body comprises a diameter ranging from 0.875 inches to 2.5 inches.

16. A method for monitoring a wellbore and actuating a downhole device, the method comprising the steps of:

storing a first parameter comprising a pressure range in a remote actuation tool;

storing a second parameter comprising a temperature range in the remote actuation tool;

storing a third parameter comprising an acceleration range in the remote actuation tool;

inserting the remote actuation tool into the wellbore;

using a pressure sensor, a temperature sensor, and an acceleration sensor associated with the remote actuation tool to receive and store a pressure, a temperature, and an acceleration, respectively;

comparing the pressure, the temperature, and the acceleration with the pressure range, the temperature range, and the acceleration range, respectively, to form a determination;

initiating an actuation process to actuate a downhole device associated with the remote actuation tool responsive to the determination;

receiving and storing a failsafe temporal parameter comprising a failsafe duration; and preventing initiation of the actuation process after the failsafe duration has elapsed.

17. The method of claim 16, wherein the step of inserting the remote actuation tool into the wellbore comprises inserting the remote actuation tool into coiled tubing, small diameter pipe, or combinations thereof.

18. The method of claim 16, wherein the step of initiating the actuation process to actuate the downhole device responsive to the determination further comprises the steps of:

receiving and storing a first temporal parameter comprising a first duration;

comparing the pressure, the temperature, and the acceleration with the pressure range, the temperature range, and the acceleration range, respectively, for the first duration to form the determination;

receiving and storing a second temporal parameter comprising a second duration; and actuating the downhole device after the second duration has elapsed.

19. The method of claim 18, wherein the step of actuating the downhole device after the second duration has elapsed further comprises the steps of:

comparing the pressure, the temperature, and the acceleration with the pressure range, the temperature range, and the acceleration range, respectively, during the second duration, to form an additional determination; and ceasing the actuation process responsive to the additional determination.

20. The method of claim 16, further comprising the step of modifying the first parameter, the second parameter, the third parameter, or combinations thereof, after inserting the remote actuation tool into the wellbore.

21. A kit for monitoring a wellbore and actuating a downhole device, the kit comprising:

a remote actuation mechanism comprising:

a body adapted for insertion into the wellbore;

a processor within the body;

a first sensor within the body and in communication with the processor, wherein the first sensor is adapted to detect a pressure associated with the body;

a second sensor within the body and in communication with the processor, wherein the second sensor is adapted to detect a temperature associated with the body;

a third sensor within the body and in communication with the processor, wherein the third sensor is adapted to detect an acceleration associated with the body;

a first connector adapted for engagement between the remote actuation mechanism and a conduit for moving the remote actuation mechanism within the wellbore;

a second connector adapted for engagement between the remote actuation mechanism and the downhole device; and data storage within the body and in communication with the processor, wherein the data storage comprises computer instructions for instructing the processor to:

receive and store a first preselected parameter comprising a pressure range;

receive and store a second preselected parameter comprising a temperature range;

receive and store a third preselected parameter comprising an acceleration range;

receive and store the pressure, the temperature, and the acceleration from the first sensor, the second sensor, and the third sensor, respectively;

compare the pressure, the temperature, and the acceleration with the pressure range, the temperature range, and the acceleration range, respectively, to form a determination; and initiate an actuation process responsive to the determination;

receive and store a failsafe temporal parameter comprising a failsafe duration; and prevent initiation of the actuation process after the failsafe duration has elapsed; and at least one housing member adapted for at least partially enclosing the remote actuation mechanism.

22. The kit of claim 21, wherein said at least one housing member comprises a plurality of housing members, and wherein each of said housing members comprises a respective diameter, and the conduit comprises a conduit diameter greater than the respective diameter.

23. The kit of claim 21, wherein the body, said at least one housing member, or combinations thereof, comprises a diameter sized for insertion into coiled tubing, small diameter pipe, or combinations thereof.

24. The kit of claim 21, wherein the computer instructions for instructing the processor to initiate the actuation process responsive to the determination further comprise computer instructions for instructing the processor to:

receive and store a first preselected temporal parameter comprising a first duration;

compare the pressure, the temperature, and the acceleration with the pressure range, the temperature range, and the acceleration range, respectively, for the first duration to form the determination;

receive and store a second preselected temporal parameter comprising a second duration; and actuate the downhole device after the second duration has elapsed.

25. The kit of claim 24, wherein the computer instructions for instructing the processor to actuate the downhole device after the second duration has elapsed further comprise computer instructions for instructing the processor to:

compare the pressure, the temperature, and the acceleration with the pressure range, the temperature range, and the acceleration range, respectively, during the second duration, to form an additional determination; and cease the actuation process responsive to the additional determination.

26. The kit of claim 21, further comprising at least one power source adapted for placement within the body, wherein said at least one power source comprises at least one fuel cell.

27. The kit of claim 21, further comprising at least one power source adapted for association with the body, wherein the power source comprises an in situ power generator.

28. The kit of claim 27, wherein the in situ power generator comprises:

a windable spring associated with the downhole device, wherein unwinding of the spring causes actuation of the downhole device; and a release mechanism in communication with the windable spring, wherein the release mechanism prevents unwinding of the spring until the release mechanism is actuated to release the windable spring, and wherein initiation of the actuation process releases the windable spring.

29. The kit of claim 27, wherein the in situ power generator comprises:

a movable member associated with a downhole device and a fluid flowpath, wherein fluid in the fluid flowpath causes movement of the movable member, and wherein movement of the movable member causes actuation of the downhole device.

30. The kit of claim 21, wherein the body comprises:

a first member having a first end, a second end, and a power source disposed therein;

a connector engaged with the first end of the first member; and a second member engaged with the connector.

31. The kit of claim 30, wherein the connector comprises at least one grounding spring positioned about a circumference thereof between the connector and the first member, between the connector and the second member, or combinations thereof.

32. The kit of claim 30, further comprising at least one end member engaged with the second end of the first member, with the second member, or combinations thereof, wherein said at least one end member comprises at least one grounding spring positioned about a circumference thereof.

33. The kit of claim 21, wherein the body comprises a length ranging from 30 inches to 50 inches.

34. The kit of claim 21, wherein the body comprises a diameter ranging from 0.875 inches to 2.5 inches.

35. The kit of claim 21, further comprising a display device and an input device adapted for communication with the processor to transmit the first preselected parameter, the second preselected parameter, and the third preselected parameter thereto, and to receive the pressure, the temperature, the acceleration, the determination, or combinations thereof, therefrom.

36. The kit of claim 35, further comprising a wireless interface between the display device and the input device and the processor for enabling wireless communication therebetween for resetting the remote actuation mechanism, reprogramming the remote actuation mechanism, actuating the remote actuation mechanism, or combinations thereof.

37. The kit of claim 21, further comprising a pressure simulation assembly for applying a test pressure to the first sensor, wherein the pressure simulation assembly comprises an end engageable with the first sensor and a movable portion for applying pressure to the first sensor, the end, or combinations thereof.

38. A system for monitoring a wellbore and actuating a downhole device, the system comprising:

an elongate body adapted for insertion into the wellbore;

a processor within the elongate body;

a first sensor within the elongate body and in communication with the processor, wherein the first sensor detects a pressure associated with the elongate body;

a second sensor within the elongate body and in communication with the processor, wherein the second sensor detects a temperature associated with the elongate body;

a third sensor within the elongate body and in communication with the processor, wherein the third sensor detects an acceleration associated with the elongate body; and data storage within the elongate body and in communication with the processor, wherein the data storage comprises computer instructions for instructing the processor to:

receive and store a first preselected parameter comprising a pressure range;

receive and store a second preselected parameter comprising a temperature range;

receive and store a third preselected parameter comprising an acceleration range;

receive and store the pressure, the temperature, and the acceleration from the first sensor, the second sensor, and the third sensor, respectively;

compare the pressure, the temperature, and the acceleration with the pressure range, the temperature range, and the acceleration range, respectively, to form a determination;

receive and store a first preselected temporal parameter comprising a first duration;

compare the pressure, the temperature, and the acceleration with the pressure range, the temperature range, and the acceleration range, respectively, for the first duration to form the determination;

receive and store a second preselected temporal parameter comprising a second duration;

actuate the downhole device associated with the elongate body after the second duration has elapsed; and compare the pressure, the temperature, and the acceleration with the pressure range, the temperature range, and the acceleration range, respectively, during the second duration, to form an additional determination; and cease the actuation process responsive to the additional determination.

39. A method for monitoring a wellbore and actuating a downhole device, the method comprising the steps of:

storing a first parameter comprising a pressure range in a remote actuation tool;

storing a second parameter comprising a temperature range in the remote actuation tool;

storing a third parameter comprising an acceleration range in the remote actuation tool;

inserting the remote actuation tool into a wellbore;

using a pressure sensor, a temperature sensor, and an acceleration sensor associated with the remote actuation tool to receive and store a pressure, a temperature, and an acceleration, respectively;

comparing the pressure, the temperature, and the acceleration with the pressure range, the temperature range, and the acceleration range, respectively, to form a determination;

initiating an actuation process to actuate a downhole device associated with the remote actuation tool responsive to the determination by:

receiving and storing a first temporal parameter comprising a first duration;

comparing the pressure, the temperature, and the acceleration with the pressure range, the temperature range, and the acceleration range, respectively, for the first duration to form the determination;

receiving and storing a second temporal parameter comprising a second duration; and actuating the downhole device after the second duration has elapsed;

comparing the pressure, the temperature, and the acceleration with the pressure range, the temperature range, and the acceleration range, respectively, during the second duration, to form an additional determination; and ceasing the actuation process responsive to the additional determination.

40. A kit for monitoring a wellbore and actuating a downhole device, the kit comprising:

a remote actuation mechanism comprising:

a body adapted for insertion into the wellbore;

a processor within the body;

a first sensor within the body and in communication with the processor, wherein the first sensor is adapted to detect a pressure associated with the body;

a second sensor within the body and in communication with the processor, wherein the second sensor is adapted to detect a temperature associated with the body;

a third sensor within the body and in communication with the processor, wherein the third sensor is adapted to detect an acceleration associated with the body;

a first connector adapted for engagement between the remote actuation mechanism and a conduit for moving the remote actuation mechanism within the wellbore;

a second connector adapted for engagement between the remote actuation mechanism and the downhole device; and data storage within the body and in communication with the processor, wherein the data storage comprises computer instructions for instructing the processor to:

receive and store a first preselected parameter comprising a pressure range;

receive and store a second preselected parameter comprising a temperature range;

receive and store a third preselected parameter comprising an acceleration range;

receive and store the pressure, the temperature, and the acceleration from the first sensor, the second sensor, and the third sensor, respectively;

compare the pressure, the temperature, and the acceleration with the pressure range, the temperature range, and the acceleration range, respectively, to form a determination; and initiate an actuation process responsive to the determination receive and store a first preselected temporal parameter comprising a first duration;

compare the pressure, the temperature, and the acceleration with the pressure range, the temperature range, and the acceleration range, respectively, for the first duration to form the determination;

receive and store a second preselected temporal parameter comprising a second duration;

actuate the downhole device after the second duration has elapsed;

compare the pressure, the temperature, and the acceleration with the pressure range, the temperature range, and the acceleration range, respectively, during the second duration, to form an additional determination; and cease the actuation process responsive to the additional determination; and at least one housing member adapted for at least partially enclosing the remote actuation mechanism.

* * * * *